US006854446B2

(12) United States Patent
Kawamura et al.

(10) Patent No.: US 6,854,446 B2
(45) Date of Patent: Feb. 15, 2005

(54) FUEL INJECTION APPARATUS

(75) Inventors: Kiyomi Kawamura, Nisshin (JP); Yoshihiro Hotta, Nagoya (JP); Yoshifumi Wakisaka, Aichi-gun (JP); Kiyomi Nakakita, Nishikamo-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/484,104

(22) PCT Filed: Jul. 11, 2002

(86) PCT No.: PCT/JP03/08856

§ 371 (c)(1),
(2), (4) Date: Mar. 10, 2004

(87) PCT Pub. No.: WO2004/007947

PCT Pub. Date: Jan. 22, 2004

(65) Prior Publication Data

US 2004/0237930 A1 Dec. 2, 2004

(30) Foreign Application Priority Data

Jul. 11, 2002 (JP) ..... 2002-203203

(51) Int. Cl.[7] ..... F02M 7/00
(52) U.S. Cl. ..... 123/447; 123/446
(58) Field of Search ..... 123/446, 447, 123/448, 449, 451, 456

(56) References Cited

U.S. PATENT DOCUMENTS 4,271,807 A 6/1981 Link et al.
5,622,152 A 4/1997 Ishida
5,732,679 A * 3/1998 Takahasi et al. ..... 123/467
6,543,420 B2 * 4/2003 Kohketsu et al. ..... 123/447

FOREIGN PATENT DOCUMENTS

| | | |
|---|---|---|
| JP | U 55-106360 | 2/1955 |
| JP | U 57-193060 | 5/1956 |
| JP | U 61-149770 | 9/1986 |
| JP | A 2002-364484 | 12/2002 |

* cited by examiner

*Primary Examiner*—Bibhu Mohanty
(74) *Attorney, Agent, or Firm*—Oliff & Berridge, PLC

(57) ABSTRACT

A fuel injection device is provided which can inject fuel by very high injection pressure and can realize favorable combustion and exhaust characteristics, and moreover, enables performance of fuel injection with arbitrary fuel injection patterns. In the fuel injection device 30, the protrusion 61 is provided at a distal end portion of the piston control valve 60 which is provided at the pressure intensifier 54, can change a practical opening area of the fuel flow path 57 to the cylinder 56 in accordance with movement of the piston control valve 60, and can control inflow amounts of liquid fuel that is flowed into the cylinder 56 by the piston control valve 60 (does orifice control). Thus, control of injection rates and injection pressures of fuel that is injected from the fuel injection nozzle 34 is enabled, and fuel injection patterns can be realized with an extremely high degree of freedom.

8 Claims, 24 Drawing Sheets

FUEL INJECTION APPARATUS

TECHNICAL FIELD

The present invention relates to a fuel injection device which injects liquid fuel that has pressurized from a fuel injection nozzle.

BACKGROUND TECHNOLOGY

A pressure accumulator-type (common rail-type) fuel injection device is known which pressure-accumulates fuel, which is pumped by a high-pressure feed pump, with a pressure accumulator (a "common rail") and injects this fuel from a fuel injection nozzle into a cylinder of an engine with a predetermined timing.

With such a pressure accumulator-type fuel injection device, even if a rotation speed of the engine is at a slow speed, a predetermined fuel injection pressure can be maintained (the fuel injection pressure will not fall), which contributes greatly to improvements in fuel consumption and increases in power output, due to fuel injection by high pressure.

Anyway, it is known that reducing diameter of a nozzle injection aperture in a fuel injection device is effective for the realization of favorable emissions (cleaning of exhaust gases). However, if something that is even smaller than a current injection aperture diameter is employed at the injection pressure of a conventional pressure accumulator-type fuel injection device (a common rail injection system), injection periods at high engine rotation speeds and high load regions become too long, so this is expected to be disadvantageous for increasing power output.

Further, in recent years, there has been a tendency for higher rotation speeds to be anticipated in small-type diesel engines. Here, airflow speed in an engine cylinder increases substantially proportionally to the engine rotation speed. Therefore, with the same injection pressure, spray is more easily flowed at times of high rotation speeds in comparison with times of low rotation speeds, an air utilization rate in the cylinder falls, and smoke (black smoke) is more likely to be exhausted. Accordingly, in order to remedy this, it is desired that the injection pressure should be made even higher. However, a conventional pressure accumulator-type fuel injection device (common rail injection system) as described above is a structure which pressure-accumulates a constant predetermined pressure in the pressure accumulator (for example, in a current common rail injection system, a maximum injection pressure is of the order of 130 MPa). With regard to strength of the device, there is a limit to increases in pressure therebeyond (in other words, it is difficult to make a conventionally increased injection pressure a very high injection pressure).

Meanwhile, a fuel injection device in which a pressure intensification device is further provided at such a pressure accumulator-type fuel injection device has been proposed (for example, the publication of Japanese Patent Application Laid-Open (JP-A) No. 8-21332).

In a fuel injection device disclosed in the above-mentioned publication, a pressure intensification device is provided which further pressurizes pressurized liquid fuel delivered from a pressure accumulator (common rail), by action of a switching valve for piston operation. This pressure intensification device is equipped with a pressure intensification piston formed of a large-bore piston and a small-bore piston, and a plurality of fuel lines which communicate with the switching valve for piston operation. Fuel, which has been delivered from a fuel pressurizing pump, is flowed from the pressure accumulator into the pressure intensification device via the switching valve for piston operation, and is further supplied to a fuel chamber for injection control (an injector control chamber), which is for injection nozzle control, and to an injection nozzle. This is a structure which, when fuel is to be injected, controls switching between low-pressure injection, which sends liquid fuel from the pressure accumulator directly (just as it is) to the injection nozzle for injection, and high-pressure injection, which sends liquid fuel that has been further pressurized at the pressure intensification device to the injection nozzle for injection, by a switching valve for fuel injection control, which is provided at the fuel chamber for injection control. Accordingly, a fuel injection state can be set to be appropriate to driving conditions of the engine.

However, in this fuel injection device, there has been a drawback in that the problem described below occurs.

That is, in the fuel injection device described above, a fuel entrance opening area from the pressure accumulator to a large-bore piston side of the pressure intensifier and a fuel exit opening area of a small-bore piston side of the pressure intensifier, which communicates with the switching valve for piston operation, are fixed structures. Therefore, a time history of fuel pressure when the pressure intensifier is operated is primarily determined by fuel pressure of the pressure accumulator. An example thereof is shown in FIGS. 24A and 24B. As shown in FIG. 24A, if a horizontal axis represents time (seconds), a time history of fuel pressure downstream of the pressure intensifier does not depend on engine rotation speed. In contrast, as shown in FIG. 24B, if the horizontal axis represents engine crank angle, pressure rises become slower in accordance with the engine rotation speed becoming higher. Therefore, particularly with high loading, specifying longer injection periods in accordance with higher engine rotation speeds on a crank angle basis is unavoidable. Such injection periods becoming too long is a factor hindering increases in power output, and is not preferable.

As one technique for avoiding this, increasing fuel pressure of the pressure accumulator (common rail) in accordance with high engine rotation speeds, increasing a force which acts at the pressure intensifier, and increasing a rate of rise of fuel pressure downstream of the pressure intensification piston is available. However, in medium and high load regions, it is necessary for an injection pressure of a main injection to be a high pressure. Moreover, at this time, with a view to noise reduction and exhaust improvement, a pilot injection (injecting fuel before the main injection) or a multiple injection (a plurality of cycles of fuel injection) is implemented. However, an optimum value of injection pressure of this pilot injection is different from the main injection pressure, and is ordinarily a lower pressure than the same. A reason for this is because air temperature and density in the cylinder are low because the injection is considerably early relative to a compression dead point, and thus, if the injection pressure is set too high, penetrative force of the injection becomes excessively large and fuel adhesion at a cylinder liner surface is caused. However, in the proposed fuel injection device described above, in order to generate a high injection pressure in a high engine rotation speed region, it is necessary to raise an injection pressure that is effected at the large-bore piston of the pressure intensifier (the fuel pressure of the pressure accumulator). Therefore, an injection pressure at the time of a pilot injection, which injects fuel of the pressure accumulator just as it is, is too high compared to an optimum value, fuel adhesion to the cylinder liner surface cannot be avoided, and this is expected to be a cause for the generation of uncombusted hydrocarbons or smoke.

On the other hand, if specifications are done such that a pilot injection (fuel pressure of the pressure accumulator) and a pressure downstream of the pressure intensification piston during operation of the pressure intensifier that are suited to a time of high engine rotation speed are provided (for example, a fuel line to the large bore side of the pressure intensification piston is enlarged), a rise in the fuel pressure downstream of the pressure intensification piston during operation of the pressure intensifier at a time of low engine rotation speed is, on a crank angle basis, precipitous. Therefore, an initial period injection rate becomes too high, a pre-mixing combustion ratio increases, and NOx and noise become worse. If, in order to avoid this, fuel pressure of the pressure accumulator at times of low engine rotation speed is lowered and the initial period injection rate of the main injection is made appropriate, an atomization state of the pilot injection which injects at the fuel pressure of the pressure accumulator deteriorates, which leads to the generation of smoke.

In contrast, if, as shown in FIG. 25, the rate of rise of the fuel pressure downstream of the pressure intensification piston during operation of the pressure intensifier is set to a characteristic which increases with time, in a state in which an optimum fuel pressure of the pilot injection (fuel pressure of the pressure accumulator) is set even at high engine rotation speeds and times of high loading, the main injection can also maintain a high fuel pressure (the fuel pressure downstream of the pressure intensification piston). As a result, the problem described above can be solved, and thus it is possible to realize a low NOx, low noise, high power output engine. However, such a specification has not been possible hitherto.

Additionally, a fuel injection device equipped with a pressure intensification device has been proposed (DE 19939428 A1). However, this fuel injection device has practical objectives of improvement of injection pressure setting accuracy, durability of a nozzle seat portion, improvement of reliability and the like.

In consideration of the circumstances described above, the present invention has an object of providing a fuel injection device capable of injecting fuel by an injection pressure which is high in comparison to convention, and capable of enlarging a degree of freedom of fuel injection patterns without maximum injection pressure being determined primarily by fuel pressure of a pressure accumulator.

DISCLOSURE OF THE INVENTION

In order to achieve the objects described above, a fuel injection device recited in claim 1 is characterized by being equipped with: a pressure accumulator communicated with a fuel pool in a fuel injection nozzle via a main fuel line, which accumulates pressure to set liquid fuel, which is pumped from a fuel pressurization pump, to a predetermined pressure; a pressure-blocking valve provided partway along the main fuel line that communicates the fuel injection nozzle with the pressure accumulator, which blocks outflow of pressurized fuel from the fuel injection nozzle side toward the pressure accumulator side; a fuel chamber for injection control which communicates at a downstream side, relative to the pressure-blocking valve, of the main fuel line that communicates the fuel injection nozzle with the pressure accumulator; an injection control valve provided at the fuel chamber for injection control, which obtains closure of a needle valve in the fuel injection nozzle by effecting liquid fuel pressure at the fuel chamber for injection control, and opens the needle valve and obtains performance of fuel injection by removing liquid fuel of the fuel chamber for injection control; a pressure intensifier having a cylinder and a piston, which communicates with the fuel chamber for injection control at the downstream side, relative to the pressure-blocking valve, of the main fuel line that communicates the fuel injection nozzle with the pressure accumulator; and a piston control valve which moves the piston of the pressure intensifier by flowing in fuel from the pressure accumulator to the cylinder or by flowing out fuel in the cylinder, and obtains an increase of fuel pressure of the downstream side relative to the pressure-blocking valve, wherein flow amount-changing means capable of changing flow amounts of the fuel that is flowed into the cylinder or flowed out by the piston control valve is provided.

A fuel injection device recited in claim 2 is characterized by, in the fuel injection device recited in claim 1, the flow amount-changing means being provided at the piston control valve and being a protrusion which changes an area of the fuel flow path of the cylinder in accordance with movement of the piston control valve.

A fuel injection device recited in claim 3 is characterized by, in the fuel injection device recited in claim 1, the flow amount-changing means having: a fixed orifice which communicates with a fuel chamber of the piston control valve; a movable orifice which overlaps and communicates with the fixed orifice, and changes a degree of overlap with the fixed orifice by moving; and moving means which moves the movable orifice.

A fuel injection device recited in claim 4 is characterized by, in the fuel injection device recited in claim 1, the flow amount-changing means being a pressure regulator which is provided at an inflow path of fuel into the cylinder or an outflow path of fuel from the cylinder.

A fuel injection device recited in claim 5 is characterized by, in the fuel injection device recited in claim 1, residual pressure-regulating means, which regulates pressure in the cylinder to a predetermined pressure at a time of non-operation of the piston control valve, being provided.

A fuel injection device recited in claim 6 is characterized by, in the fuel injection device recited in claim 1, resupplying means for again supplying fuel, which has been discharged from in the cylinder in accordance with movement of the piston at a time of operation of the piston control valve, to the fuel pressurization pump being provided.

A fuel injection device recited in claim 7 is characterized by being equipped with: a pressure accumulator communicated with a fuel pool in a fuel injection nozzle via a main fuel line, which accumulates pressure to set liquid fuel, which is pumped from a fuel pressurization pump, to a predetermined pressure; a pressure-blocking valve provided partway along the main fuel line that communicates the fuel injection nozzle with the pressure accumulator, which blocks outflow of pressurized fuel from the fuel injection nozzle side toward the pressure accumulator side; a fuel chamber for injection control which communicates at a downstream side, relative to the pressure-blocking valve, of the main fuel line that communicates the fuel injection nozzle with the pressure accumulator; an injection control valve provided at the fuel chamber for injection control, which obtains closure of a needle valve in the fuel injection nozzle by effecting fuel pressure at the fuel chamber for injection control, and opens the needle valve and obtains performance of fuel injection by removing liquid fuel of the fuel chamber for injection control; a pressure intensifier having a cylinder and a piston, which communicates with the fuel chamber for injection control at the downstream side, relative to the pressure-blocking valve, of the main fuel line that communicates the fuel injection nozzle with the pressure accumulator; and a piston control valve which moves the piston of the pressure intensifier by flowing in fuel from the pressure accumulator to the cylinder or by flowing out fuel in the cylinder, and obtains an increase of fuel pressure of the downstream side relative to the pressure-blocking valve, wherein residual pressure-regulating means which regulates pressure in the cylinder to a predetermined pressure at a time of non-operation of the piston control valve is provided.

A fuel injection device recited in claim 8 is characterized by, in the fuel injection device recited in claim 7, resupplying means for again supplying fuel, which has been discharged from in the cylinder in accordance with movement of the piston at a time of operation of the piston control valve, to the fuel pressurization pump being provided.

In the fuel injection device recited in claim 1, the pressure accumulator, the pressure-blocking valve, the fuel chamber for injection control, the injection control valve, the pressure intensifier and the piston control valve are provided. At the pressure intensifier, fuel is supplied (at common rail pressure) from the pressure accumulator, and the same is pressure-intensified. Further, here, a pressure accumulator injection system (common rail injector) to the fuel injection nozzle is structured by the pressure accumulator, the pressure-blocking valve, the fuel chamber for injection control and the injection control valve. Moreover, the pressure intensifier is arranged in parallel with this pressure accumulator injection system. In other words, a pressure intensifier injection system (jerk injector) to the fuel injection nozzle is structured by the pressure intensifier, the piston control valve, the fuel chamber for injection control and the injection control valve.

When fuel is to be injected by the pressure accumulator injection system (the common rail injector), the pressure intensifier is set to a non-operating state by the piston control valve, and moreover, liquid fuel from the pressure accumulator is pumped through the pressure-blocking valve to a fuel pool at the fuel injection nozzle. At this time, liquid fuel of the fuel chamber for injection control is removed by the injection control valve, and thus liquid fuel from the pressure accumulator is directly (just as it is) injected from the fuel injection nozzle.

On the other hand, when fuel is to be injected by the pressure intensifier injection system (the jerk injector), the pressure intensifier is set to an operating state by the piston control valve. Accordingly, liquid fuel which has been further pressurized by the pressure intensifier is pumped to the fuel pool in the fuel injection nozzle and the fuel chamber for injection control. At this time, liquid fuel of the fuel chamber for injection control is removed by the injection control valve, and thus the liquid fuel which has been pressure-intensified at the pressure intensifier is injected from the fuel injection nozzle.

Thus, with this fuel injection device, it is possible to switch control for fuel injection between low-pressure injection, which sends liquid fuel from the pressure accumulator just as it is to the fuel injection nozzle for injection, and high-pressure injection, which sends liquid fuel that has been further pressurized at the pressure intensifier to the fuel injection nozzle for injection. Accordingly, this fuel injection device is a thing which essentially implements the following effects.

(1) The fuel is supplied (at the common rail pressure) from the pressure accumulator to the pressure intensifier, and this is pressure-intensified and injected. Thus, conversion to a very high injection pressure which exceeds an injection pressure from a conventional common rail injection system can be realized.

(2) The pressure accumulator injection system (the common rail injector) and the pressure intensifier are arranged in parallel, and are a structure which supplies fuel from the pressure accumulator when a fuel pressure downstream relative to the pressure-blocking valve becomes lower than or equal to the common rail pressure. Thus, the fuel will not be injected at low pressure. Further, the fuel pressure will not be lower than or equal to a vapor pressure of the fuel.

(3) Because the pressure accumulator injection system (the common rail injector) and the pressure intensifier are arranged in parallel, injection at the common rail pressure is possible even if the pressure intensifier is temporarily out of order in a state which is blocked between the pressure accumulator and the pressure intensifier. Therefore, the engine will not suddenly stop.

Further, here, with the pressure injection device recited in claim 1, a flow amount-changing means, which is capable of changing flow amounts of fuel which is flowed into the cylinder or flowed out by the piston control valve, is provided. Accordingly, when fuel is to be injected, it is possible to control the injection rate of the fuel that is injected from the fuel injection nozzle.

That is, according to this fuel injection device, when an inflow amount of the fuel into the cylinder or an outflow amount is changed by the flow amount-changing means, a speed of movement of the piston is changed, and it is possible to arbitrarily specify an injection rate of the fuel that is injected from the fuel injection nozzle. Accordingly, fuel injection patterns can be realized with an extremely high degree of freedom.

With the fuel injection device recited in claim 2, when fuel is to be injected, if the piston control valve is moved, an area of a fuel flow path of the cylinder is changed by the protrusion in accordance with a movement amount (lift amount) of this piston control valve. When the fuel flow path area of the cylinder is changed, the inflow amount of the fuel into the cylinder or the outflow amount is changed and the movement speed of the piston is changed, and it is possible to arbitrarily set the injection rate of the fuel that is injected from the fuel injection nozzle. Accordingly, fuel injection patterns can be realized with an extremely high degree of freedom.

In other words, when fuel is to be injected, if shape and the like of the protrusion have been specified in accordance with an optimum injection amount of the fuel that is injected from the fuel injection nozzle (for example, an optimum injection rate of a pilot injection, main injection or the like corresponding to engine rotation speed, loading state and the like), the fuel injection can be performed at the optimum injection rate when a needle valve is opened and fuel injection is performed.

By the way, when the fuel flow path area of the cylinder is controlled (changed) by the protrusion provided at the piston control valve, for example, an opening area of the fuel flow path can be structured so as to change linearly (sequentially and smoothly) with respect to the movement amount (lift amount) of the piston control valve but is not limited to this and, for example, the shape of the protrusion can also be set to two levels and structured such that the opening area of the flow path changes stepwise. Further, if positional control is carried out such that movement (lifting) of the piston control valve stops partway through (at an intermediate position), this is more effective. Such a case can be realized by carrying out position control using a piezoelectric element, a super-magnetostrictive element or the like. Further, it is of course possible to carry out position control with a solenoid valve.

Further here, ordinarily, a thing with a "flat seat form" is known to serve as a valve form of the piston control valve. An effective flow path cross-sectional area thereof is regulated by a valve seat portion. That is, this flat seat-form control valve is a structure which regulates a cross-sectional area (a practical opening area) at the valve seat portion by control of lift amounts (movement amounts) of the valve ("seat portion area control").

In contrast, in the fuel injection device recited in claim 2, rather than regulating the cross-sectional area at the valve seat portion as described above (seat portion area control), the protrusion changes the area of the fuel flow path in accordance with movement of the piston control valve. That is, the protrusion is provided at the piston control valve to be present in the fuel flow path (an orifice), and this is a structure which possesses a "fuel flow path area variability function" which changes the area of the fuel flow path by changing a position of the protrusion in accordance with the movement amount (lift amount) of this piston control valve.

Accordingly, in a thing with an ordinary structure which regulates cross-sectional area at a valve seat portion as described above (seat portion area control), the cross-sectional area at the valve seat portion changes linearly in accordance with lift amounts (movement amounts) of the valve. In contrast, in the fuel injection device recited in claim 2, by variously suitably specifying the form of the protrusion, changes of the fuel flow path area in accordance with movement amounts (lift amounts) of the piston control valve can be freely specified. Thus, it is possible to arbitrarily specify the injection rate of the fuel that is injected from the fuel injection nozzle, and fuel injection patterns can be realized with an extremely high degree of freedom.

Therefore, with the fuel injection device recited in claim 2, the following distinctive excellent effects are implemented.

1) An Improvement of Injection Pressure Setting Accuracy

Something with an ordinary structure which regulates cross-sectional area at a valve seat portion as described above (seat portion area control) is a structure which linearly changes the cross-sectional area at the valve seat portion in accordance with lift amounts (movement amounts) of the valve. Setting accuracy of the lift amount of the valve is equivalent to the setting accuracy of the cross-sectional area at the valve seat portion (the setting accuracy of the cross-sectional area at the valve seat portion principally depends on the setting accuracy of the lift amount of the valve).

Here, the present applicant has obtained a finding, by simulations, that when fuel is to be injected by a pressure intensifier injection system (jerk injector), in a case of injecting at an injection pressure which is slightly higher than a pressure of fuel that is flowed into a cylinder of a pressure intensifier by a piston control valve (an operation pressure of the pressure intensifier, that is, common rail pressure), setting accuracy of the injection pressure can be made higher if a fuel inflow amount to the cylinder of the pressure intensifier is made smaller than an inflow amount due to opening of the valve of the ordinary structure. Accordingly, in such a case, a discrepancy of a fuel flow path area can be made smaller in relation to a discrepancy from a setting target value of the movement amount (lift amount) of the piston control valve by, for example, setting a relationship of the fuel flow path area with respect to the movement amount (lift amount) of the piston control valve to a configuration in which the smaller movement amounts are (times at which lift amounts are small), the smaller changes of the fuel flow path area become. In other words, breadth of a setting target value of the movement amount (lift amount) of the piston control valve in relation to the fuel flow path area that is to be obtained is widened. That is, even if the movement amount (lift amount) of the piston control valve is discrepant to a certain extent from the setting target value, an effect on the fuel flow path area is slight. Therefore, setting accuracy of the injection pressure (the fuel flow path area of the piston control valve) can be raised.

2) An Improvement in Durability of the Valve Seat Portion

In something with an ordinary structure which regulates cross-sectional area at a valve seat portion as described above (seat portion area control), (the opening of) the valve seat portion is a minimum flow path area. Here, in a thing with such a structure, at times of non-operation of this valve (when seated at the valve seat portion), pressure at an upstream side of the seat portion is an operational pressure thereof (that is, the common rail pressure), and the seat portion downstream side (the large bore side of the piston of the pressure intensifier) is at, for example, atmospheric pressure. When, from this state, this valve is operated and fuel is flowed in to the large bore side of the piston of the pressure intensifier (a first chamber of the cylinder), a pressure difference between before and after the seat portion (the seat portion upstream side and downstream side), is largest immediately after this valve has been operated (that is, the operational pressure minus atmospheric pressure). When the pressure difference is thus large, cavitation tends to occur. Because this cavitation occurs at the valve seat portion, this portion is corroded, leading to seating failures. Such seating failures are a serious and fatal problem which impairs the pressure intensification function of the device.

In contrast, in the fuel injection device recited in claim 2, the form of the protrusion of the piston control valve is appropriately specified and, when the movement amount (lift amount) of the piston control valve is small, the fuel flow path area can be structured so as to be even smaller than the opening area of the valve seat portion (the aforementioned minimum flow path area). Accordingly, a resulting pressure difference between before and after the seat portion (the seat portion upstream side and downstream side) can be made smaller, and the occurrence of cavitation can be prevented, even immediately after this piston control valve has been operated. Therefore, corrosion of members caused by cavitation that occurs at the valve seat portion can be prevented, and reliability and durability are greatly improved.

3) A Reduction of Cylinder Volume of the Large-Bore Piston Side of the Pressure Intensifier (a Reduction in Size)

The fuel injection device recited in claim 2 is a structure in which the protrusion is provided at the piston control valve so as to be present in the fuel flow path (the orifice). Therefore, the cylinder volume of the large-bore piston side of the pressure intensifier can be lowered (a reduction in size).

As recited in "2) An improvement in durability of the valve seat portion" above, in a case which is structured such that the fuel flow path area becomes extremely small when the movement amount (lift amount) of the piston control valve is small, if the cylinder volume of the large-bore piston side of the pressure intensifier is temporarily large, a rise in pressure in this cylinder volume may become excessively slow. With regard thereto, because this cylinder volume can be reduced by the protrusion provided at the piston control valve, even if the fuel flow path area is set to be considerably smaller in order to prevent cavitation at the valve seat portion, an appropriate rise in pressure in this cylinder volume can be obtained.

In the fuel injection device recited in claim 3, when fuel is to be injected, the movable orifice is moved by the moving means. Thus, a degree of overlap of the movable orifice with the fixed orifice is changed, and a practical opening area of these orifices is changed. Accordingly, the fuel pressure flowed into the cylinder or flowed out by the piston control valve (a rate of rise thereof) is changed, a movement speed of the piston is changed, and it is possible to arbitrarily specify the injection rate of the fuel that is injected from the fuel injection nozzle.

In other words, if forms of the fixed orifice and the movable orifice, movement speed due to the moving means and the like are specified in accordance with an optimum injection rate of the fuel that is to be injected from the fuel injection nozzle (for example, an optimum injection rate of a pilot injection, main injection or the like in accordance with engine rotation speed, loading conditions and the like), the fuel injection can be performed at the optimum injection rate when the needle valve is opened and fuel injection is performed. Accordingly, fuel injection patterns can be realized with an extremely high degree of freedom.

By the way, as the moving means for moving the movable orifice, for example, an engine governor can be applied, and can be structured so as to effect fuel pressure of a second power of the engine rotation speed to move the; movable orifice. Further, by suitably specifying the forms of the movable orifice and the fixed orifice (for example, rectangles, circles, trapeziums or the like) and altering numbers thereof, a relationship of the effective opening area of this flow path with respect to, for example, the engine rotation speed, can be freely specified.

In the fuel injection device recited in claim 4, when fuel is to be injected, the inflow pressure of the fuel into the cylinder or the outflow pressure is changed by the pressure regulator. Thus, the movement speed of the piston is changed, and it is possible to arbitrarily specify the injection rate of the fuel that is injected from the fuel injection nozzle.

In other words, when fuel is to be injected, if the pressure regulator is regulated in accordance with an optimum injection rate of the fuel that is injected from the fuel injection nozzle (for example, an optimum injection rate of a pilot injection, main injection or the like in accordance with engine rotation speed, loading conditions and the like), the fuel injection can be performed at the optimum injection rate when the needle valve is opened and the fuel injection is performed. Accordingly, fuel injection patterns can be realized with an extremely high degree of freedom. In particular, in this case, because the operation pressure of the pressure intensifier (the piston) and the fuel pressure of the pressure accumulator can be specified independently, for example, an injection pressure of a pilot injection which injects fuel by the pressure accumulator injection system (the common rail injector) and the injection pressure of a main injection which injects fuel by the pressure intensifier injection system (the jerk injector) can be controlled independently, and respective optimum injection pressures can be specified for the pilot injection and the main injection.

In the fuel injection device recited in claim 5, pressure inside the cylinder at times of non-operation of the piston control valve is regulated to the predetermined pressure by the residual pressure-regulating means.

Here, as described for the aforementioned claim 2, when the pressure difference between before and after the valve seat portion of the piston control valve (the seat portion upstream side and downstream side) is large, cavitation tends to occur. With regard thereto, in the fuel injection device recited in claim 5, because the pressure in the cylinder at a time of non-operation of the piston control valve is regulated to the predetermined pressure by the residual pressure-regulating means (because the cylinder interior of the large-bore piston side of the pressure intensifier is maintained at the predetermined pressure), the pressure difference between before and after the seat portion (the seat portion upstream side and downstream side) can be made smaller, and the occurrence of cavitation can be prevented, even immediately after the piston control valve is operated. Therefore, corrosion of members caused by cavitation that occurs at the valve seat portion can be prevented, and reliability and durability are greatly improved.

By the way, the structure which is characteristically applied in claim 5 (the residual pressure-regulating means) implements a similar operation even if combined with the structures recited in claims 2 to 4.

In the fuel injection device recited in claim 6, fuel that is discharged from in the cylinder in accordance with movement of the piston is again supplied to the fuel pressurization pump by the resupplying means. Therefore, fuel pressure energy can be recovered (re-utilized), and efficiency of the injection system can be raised.

By the way, the structure which is characteristically applied in claim 6 (the resupplying means) implements a similar operation even if combined with the structures recited in claims 2 to 5.

In the fuel injection device recited in claim 7, similarly to the fuel injection device recited in the aforementioned claim 1, a pressure accumulator injection system (common rail injector) and a pressure intensifier injection system (jerk injector) are structured, and basically the same operations as in the fuel injection device recited in claim 1 described above are provided, and the same effects are implemented.

Further, in particular, in the fuel injection device recited in claim 7, pressure in the cylinder at times of non-operation of the piston control valve is regulated to the predetermined pressure by the residual pressure-regulating means.

Here, as described for the aforementioned claim 2, when the pressure difference between before and after the valve seat portion of the piston control valve (the seat portion upstream side and downstream side) is large, cavitation tends to occur. With regard thereto, in the fuel injection device recited in claim 7, because the pressure in the cylinder at a time of non-operation of the piston control valve is regulated to the predetermined pressure by the residual pressure-regulating means (because the cylinder interior of the large-bore piston side of the pressure intensifier is maintained at the predetermined pressure), the pressure difference between before and after the seat portion (the seat portion upstream side and downstream side) can be made smaller, and the occurrence of cavitation can be prevented, even immediately after the piston control valve is operated. Therefore, corrosion of members caused by cavitation that occurs at the valve seat portion can be prevented, and reliability and durability are greatly improved.

In the fuel injection device recited in claim 8, fuel that is discharged from the cylinder interior in accordance with movement of the piston is again supplied to the fuel pressurization pump by the resupplying means. Therefore, fuel pressure energy can be recovered (re-utilized), and efficiency of the injection system can be raised.

BEST MODE FOR CARRYING OUT THE INVENTION

[First Embodiment]

Figure 1:
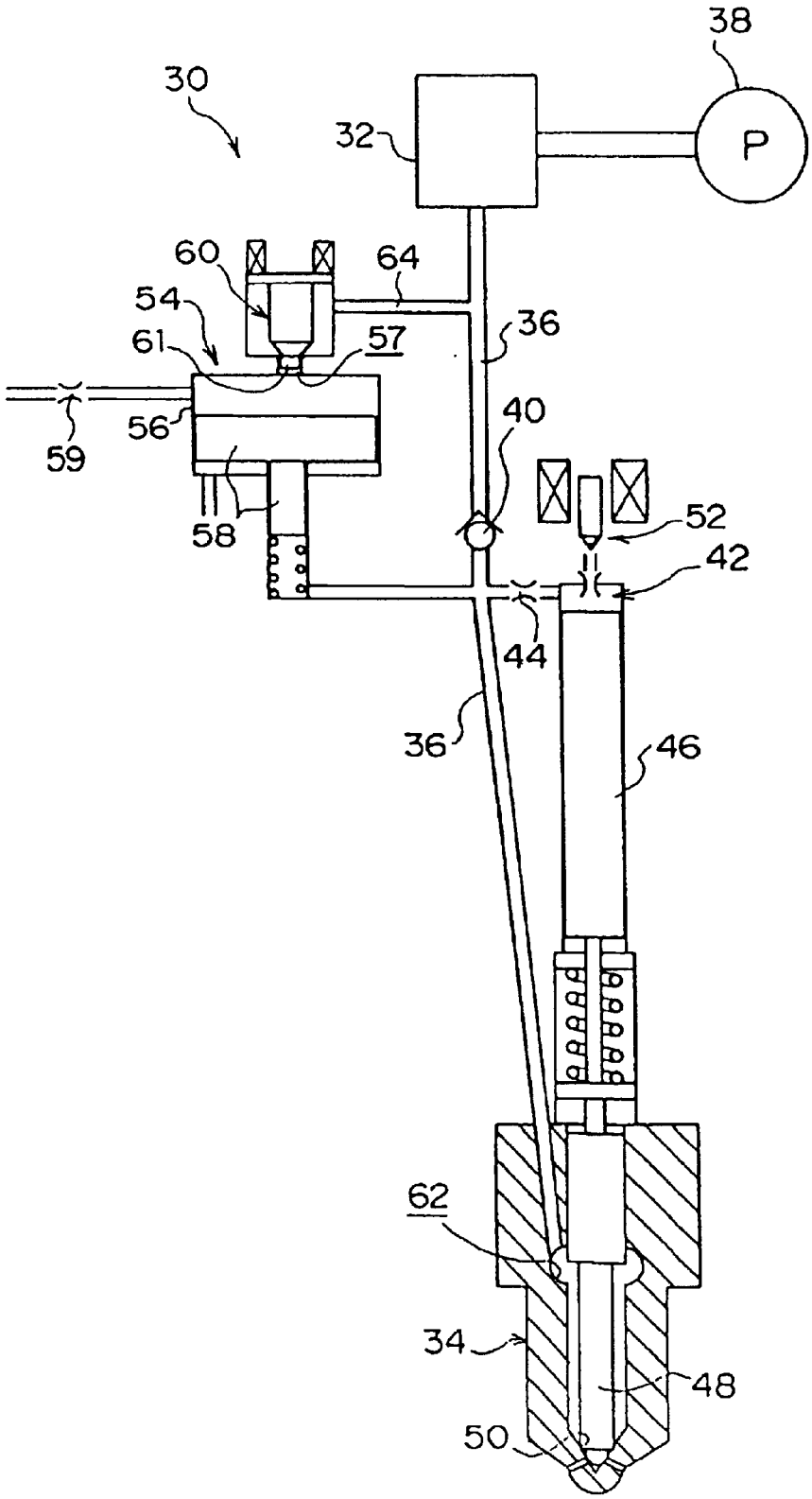
FIG. 1 is an overall structural view of a fuel injection device relating to a first embodiment of the present invention.

In FIG. 1, overall structure of a fuel injection device 30 relating to a first embodiment of the present invention is shown.

The fuel injection device 30 is equipped with a pressure accumulator (common rail) 32. This pressure accumulator 32 is communicated, via a main fuel line 36, with a fuel pool 62 in a fuel injection nozzle 34. This pressure accumulator 32 can pressure-accumulate liquid fuel that is pumped from a fuel pressurization pump 38 to a predetermined pressure in accordance with engine rotation speed, loading and the like. Further, partway along the main fuel line 36 which communicates the fuel injection nozzle 34 with the pressure accumulator 32, a pressure-blocking valve 40 is provided. This pressure-blocking valve 40 blocks outflow of fuel pressure from a side of the fuel injection nozzle 34 to a side of the pressure accumulator 32.

Furthermore, a fuel chamber for injection control 42 is provided at and communicates, via an orifice 44, with a downstream side relative to the pressure-blocking valve 40 of the main fuel line 36 that communicates the fuel injection nozzle 34 with the pressure accumulator 32. A command piston 46 is accommodated at this fuel chamber for injection control 42. Further, the command piston 46 is linked with a needle valve 48 in the fuel injection nozzle 34. Accordingly, fuel pressure in the fuel chamber for injection control 42 acts so as to push against the needle valve 48 in the fuel injection nozzle 34 and keep the needle valve 48 seated at a nozzle seat 50.

Further yet, an injection control valve 52 is provided at the fuel chamber for injection control 42. This injection control valve 52 is structured so as to continuously obtain closure of the needle valve 48 in the fuel injection nozzle 34 as described above by effecting liquid fuel pressure at the fuel chamber for injection control 42, and to open the needle valve 48 and obtain performance of fuel injection by removing the liquid fuel in the fuel chamber for injection control 42.

Further yet, a pressure intensifier 54 is arranged to communicate with the fuel chamber for injection control 42 at the downstream side relative to the pressure-blocking valve 40 of the main fuel line 36 which communicates the fuel injection nozzle 34 with the pressure accumulator 32. This pressure intensifier 54 has a cylinder 56 and a piston 58, and is structured to be able to further pressure-intensify liquid fuel from the pressure accumulator 32 and supply the same to the fuel chamber for injection control 42 and the fuel injection nozzle 34, by the piston 58 moving.

Further, a piston control valve 60 is provided at the pressure intensifier 54. This piston control valve 60 corresponds with the piston 58 at a large-bore side of the pressure intensifier 54 and is provided at a fuel line 64 from the pressure accumulator 32, moves the piston 58 by flowing liquid fuel that is supplied from the pressure accumulator 32 into the cylinder 56 via the fuel line 64, and is a structure which is capable of obtaining an increase of fuel pressure at the downstream side relative to the pressure-blocking valve 40.

By the way, the cylinder 56 at which the piston control valve 60 is provided (a portion corresponding to the large-bore side piston 58) opens to the atmosphere via an orifice 59.

Figure 2:
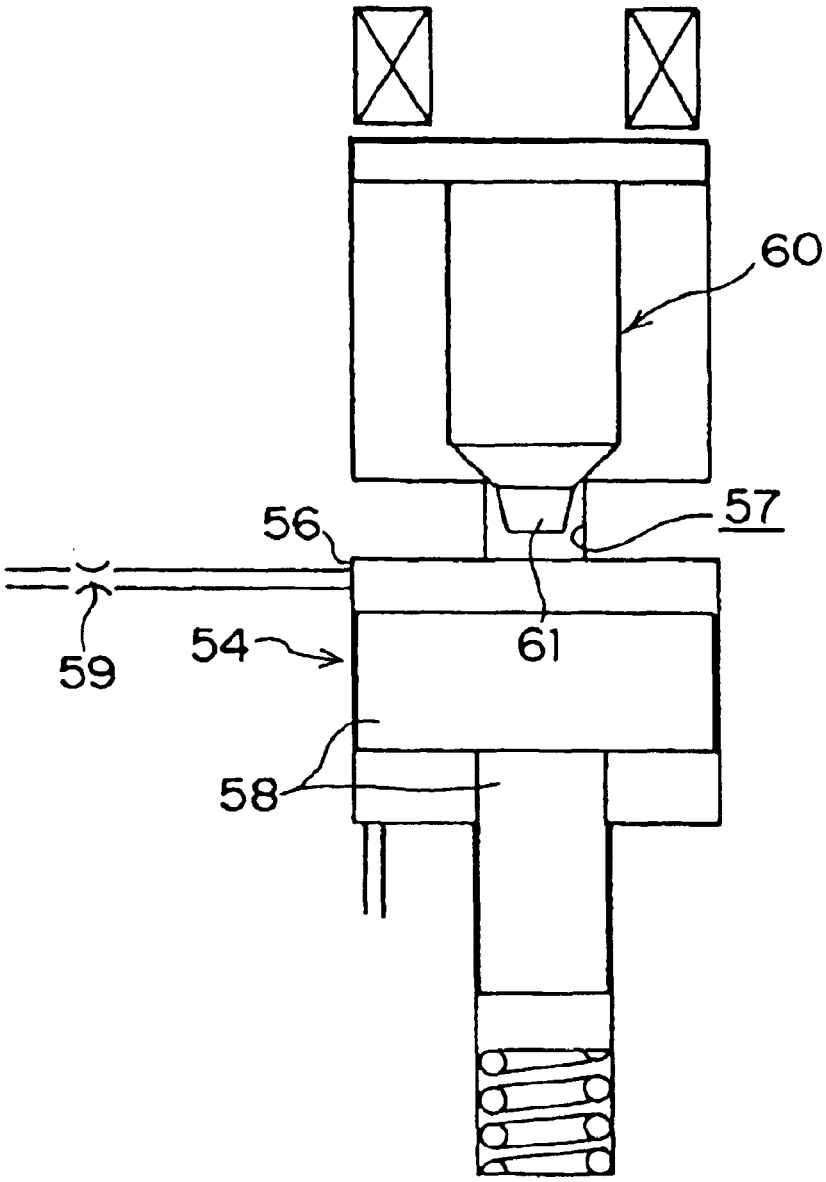
FIG. 2 is a structural view of a principal portion of the fuel injection device relating to the first embodiment of the present invention.

Further, as shown in detail in FIG. 2, at a distal end portion of the piston control valve 60, a protrusion 61 is provided to serve as flow amount-changing means. This protrusion 61 is a structure capable of changing a practical opening area of a fuel flow path 57 to the cylinder 56 in accordance with movement of the piston control valve 60 (is a structure which does orifice control, possessing a "fuel flow path area variability function", with the protrusion 61). Thus, an inflow amount of liquid fuel which is flowed into the cylinder 56 can be controlled by the piston control valve 60.

By the way, movement (lifting) of the piston control valve 60 can be implemented by carrying out position control using electromagnetic force or a PZT actuator, a super-magnetostrictive element or the like. Further, it is more effective if position control is carried out so as to stop partway through the movement (lift) of the piston control valve 60 (at an intermediate position).

Next, operation of the present embodiment will be described.

At the fuel injection device 30 of the structure described above, the pressure accumulator 32, the pressure-blocking valve 40, the fuel chamber for injection control 42, the injection control valve 52, the pressure intensifier 54 and the piston control valve 60 are provided. At the pressure intensifier 54, liquid fuel (of a common rail pressure) is supplied from the pressure accumulator 32, and this is pressure-intensified by the piston 58 moving. Further, here, a pressure accumulator injection system (a common rail injector) to the fuel injection nozzle 34 is structured by the pressure accumulator 32, the pressure-blocking valve 40, the fuel chamber for injection control 42 and the injection control valve 52, and moreover, is a structure at which the pressure intensifier 54 is arranged in parallel with this pressure accumulator injection system. In other words, a pressure intensifier injection system (a jerk injector) to the fuel injection nozzle 34 is structured by the pressure intensifier 54, the piston control valve 60, the fuel chamber for injection control 42 and the injection control valve 52.

Herein:

1) A Case of Injecting Fuel by the Pressure Accumulator Injection System (the Common Rail Injector)

Before commencement of injection, the injection control valve 52 is maintained in a closed state and makes pressure in the fuel chamber for injection control 42 equal to pressure in the pressure accumulator 32 (the common rail pressure). Accordingly, the needle valve 48 in the fuel injection nozzle 34 pushes against the nozzle seat 50 via the command piston 58, and the needle valve 48 is kept in a closed state.

When liquid fuel is to be injected, the pressure intensifier 54 is set to a non-operation state by the piston control valve 60 being set to a closed state. Further, liquid fuel from the pressure accumulator 32 is pumped to the fuel pool 62 in the fuel injection nozzle 34 via the pressure-blocking valve 40. At this time, when the liquid fuel of the fuel chamber for injection control 42 is removed by the injection control valve 52 opening, the pressure closing the needle valve 48 in the fuel injection nozzle 34 is reduced. Meanwhile, in the fuel injection nozzle 34 (the fuel pool 62), the common rail pressure is maintained. Thus, the needle valve 48 in the fuel injection nozzle 34 is opened, and the liquid fuel from the pressure accumulator 32 is directly (just as it is) injected from the fuel injection nozzle 34.

When the fuel injection is to finish, the pressure of the fuel chamber for injection control 42 is again made equal to the common rail pressure by the injection control valve 52 closing. Thus, the needle valve 48 in the fuel injection nozzle 34 is again pushed against in a closing direction, via the command piston 58, and is held seated at the nozzle seat 50, and the fuel injection finishes.

2) A Case of Injecting Fuel by the Pressure Intensifier Injection System (the Jerk Injector)

Before commencement of injection, the injection control valve 52 is maintained in the closed state and makes the pressure in the fuel chamber for injection control 42 equal to the pressure in the pressure accumulator 32 (the common rail pressure). Accordingly, the needle valve 48 in the fuel injection nozzle 34 pushes against the nozzle seat 50 via the command piston 58, and the needle valve 48 is kept in the closed state.

When liquid fuel is to be injected, liquid fuel is flowed into the pressure intensifier 54 (the cylinder 56) by the piston control valve 60 opening. Accordingly, the piston 58 moves and the fuel pressure is pressure-intensified. Then, the liquid fuel that has been pressurized by the pressure intensifier 54 is pumped to the fuel pool 62 in the fuel injection nozzle 34 and the fuel chamber for injection control 42. By the way, in this state, the pressure-blocking valve 40 moves, and prevents the pressure-intensified liquid fuel from flowing out to the pressure accumulator 32 side. Further, when the pressure-intensified liquid fuel has reached a predetermined pressure, the pressure closing the needle valve 48 in the fuel injection nozzle 34 is reduced by the liquid fuel of the fuel chamber for injection control 42 being removed by the injection control valve 52. Meanwhile, in the fuel injection nozzle 34 (the fuel pool 62), the pressure of the liquid fuel that has been pressurized by the pressure intensifier 54 acts. Thus, the needle valve 48 in the fuel injection nozzle 34 opens, and the liquid fuel that has been pressure-intensified at the pressure intensifier 54 is injected from the fuel injection nozzle 34.

When the fuel injection is to finish, the pressure of the fuel chamber for injection control 42 is again made equal to the pressure of (the fuel pool 62) in the fuel injection nozzle 34 by the injection control valve 52. Thus, the needle valve 48 in the fuel injection nozzle 34 is pushed against in the closing direction and is held seated at the nozzle seat 50, and the fuel injection finishes.

Further, in preparation for a next injection, the piston control valve 60 of the pressure intensifier 54 closes, the fuel in the pressure intensifier 54 (the cylinder 56) is opened to the atmosphere via the orifice 59, and the piston 58 is moved to its original position again. In accordance therewith, the fuel pressure downstream relative to the pressure-blocking valve 40 becomes lower than or equal to the common rail pressure and the pressure-blocking valve 40 promptly opens, and it becomes a fuel pressure substantially equal to the common rail pressure.

Thus, in the fuel injection device 30 relating to the present embodiment, a low-pressure injection, which delivers the liquid fuel from the pressure accumulator 32 to the fuel injection nozzle 34 just as it is for injection, and a high-pressure injection, which delivers the liquid fuel that has been further pressurized at the pressure intensifier 54 to the fuel injection nozzle 34 for injection, can be switchingly controlled for fuel injection. Therefore, the fuel injection device 30 is basically a thing which implements the following effects.

(1) Because the (common rail pressure) fuel from the pressure accumulator 32 is supplied to the pressure intensifier 54 and this is pressure-intensified for injection, conversion to a very high injection pressure (for example, a maximum injection pressure of 300 MPa) which greatly exceeds an injection pressure from a conventional common rail injection system can be realized. Therefore, the fuel can be injected in an appropriate injection period even at times of high engine rotation speed and high loading, and a greater raising of speed can be anticipated, together with which favorable combustion is enabled, and a high power output engine with low emissions can be realized.

Further, by converting to a very high pressure of injection pressure, compensation for a reduction of spray penetration force due to a diameter reduction of an aperture diameter of the fuel injection nozzle is enabled. Consequently, oxygen in a combustion chamber can be utilized effectively. Thus, favorable combustion states with little smoke exhaust can be realized even at high rotation speeds.

Further, because there is no need to constantly pressure-accumulate a very high injection pressure, in comparison with a conventional common rail injection system which constantly pressure-accumulates a predetermined high injection pressure, there is an advantage in regard to strength of the injection system, and a reduction in costs can be anticipated.

(2) Because the pressure accumulator injection system (the common rail injector) and the pressure intensifier 54 are arranged in parallel, and are a structure in which the fuel from the pressure accumulator 32 is supplied when the fuel pressure downstream relative to the pressure-blocking valve 40 is lower than or equal to the common rail pressure, the fuel will not be injected at a low pressure lower than or equal to the common rail pressure, even in a case of after-injecting at a time of high rotation speed or high loading. Therefore, because spray is after-injected in a favorable atomization state, the after-injected fuel itself will not become a cause for the generation of smoke, and the after-injected fuel can draw out combustion promotion effects due to disturbing combustion locations to a maximum limit.

Further, because the low-pressure injection and the high-pressure injection can be switchably controlled for injecting fuel, optimum injection pressures can be specified for each of a pilot injection, a main injection and an after-injection.

Further, it is possible to freely combine and inject injections at the common rail pressure and injections in which the pressure intensifier 54 is operated, and a degree of freedom of injection patterns is large.

(3) Because the pressure accumulator injection system (the common rail injector) and the pressure intensifier 54 are arranged in parallel, and are a structure in which the fuel from the pressure accumulator 32 is supplied when the fuel pressure downstream relative to the pressure-blocking valve 40 is lower than or equal to the common rail pressure, the injection pressure will not be lower than or equal to a vapor pressure of the fuel. Therefore, there is no concern about erosion of fuel lines due to the occurrence of cavitation, and durability is markedly improved.

(4) Because the pressure accumulator injection system (the common rail injector) and the pressure intensifier 54 are arranged in parallel, injection at the common rail pressure is possible even if the pressure intensifier 54 is temporarily out of order in a state which is blocked between the pressure accumulator 32 and the pressure intensifier 54. Therefore, the engine will not suddenly stop.

Further here, in the fuel injection device 30 relating to this first embodiment, switching control between low-pressure injection and high-pressure injection for injecting fuel is possible as described above. Therefore, optimal injection pressures can be specified for each of a pilot injection, a main injection and an after-injection. Moreover, it is possible to freely combine and inject injections at the common rail pressure and injections in which the pressure intensifier 54 is operated, and fuel injections with various injection patterns are possible. Further, the protrusion 61 is provided to serve as the flow amount-changing means which is capable of changing flow amounts of the fuel that is flowed into the cylinder 56 with the piston control valve 60. Therefore, by controlling inflow amounts of the liquid fuel by changing the area of the fuel flow path 57 (the practical opening area of the flow path) into the cylinder 56 (by doing orifice control), it is possible to control injection rates of the fuel that is injected from the fuel injection nozzle 34, and the fuel can be injected with arbitrary injection patterns.

That is, according to this fuel injection device 30, when fuel is to be injected, when the piston control valve 60 is moved, the practical opening area of the fuel flow path 57 of the cylinder 56 is changed by the protrusion 61 in accordance with movement amounts (lift amounts) of this piston control valve 60. When the opening area of the fuel flow path 57 of the cylinder 56 is changed, the inflow amount of fuel into the cylinder 56 is changed, a movement speed (displacement speed) of the piston 58 is changed, and it is possible to arbitrarily specify a pressure intensification speed of the fuel that is sent to the fuel injection nozzle 34, that is, the injection rate of the fuel that is injected from the fuel injection nozzle 34. Accordingly, fuel injection patterns can be realized with an extremely high degree of freedom.

For example, in a case in which the fuel downstream of the pressure intensifier 54 is to be steeply pressure-intensified, the lift amount of the piston control valve 60 becomes larger and the opening area of the fuel flow path 57 becomes larger. Consequently, the pressure in the cylinder 56 rapidly increases, and thus the displacement speed of the piston 58 becomes faster, and a steep rise in pressure can be obtained. On the other hand, in a case in which the fuel downstream of the pressure intensifier 54 is to be gradually pressure-intensified, the lift amount of the piston control valve 60 becomes smaller and the opening area of the fuel flow path 57 becomes smaller. Consequently, pressure in the cylinder 56 increases gradually, and thus the displacement speed of the piston 58 becomes slower, and a gradual rise in pressure can be obtained.

Figure 3A:
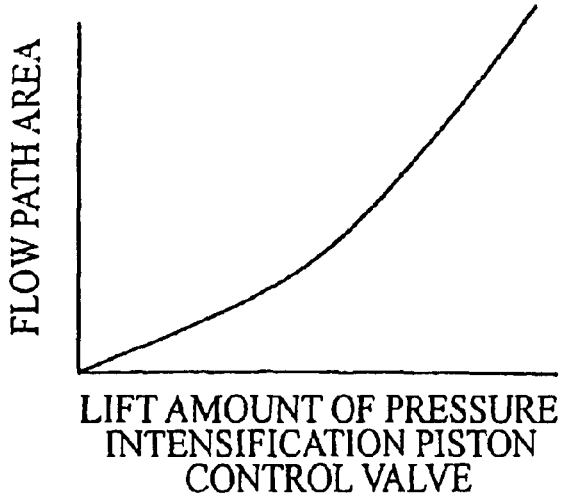
FIG. 3A is a graph showing a relationship of correspondence of movement amount of a piston control valve with flow path area in the fuel injection device relating to the first embodiment of the present invention.
Figure 3B:
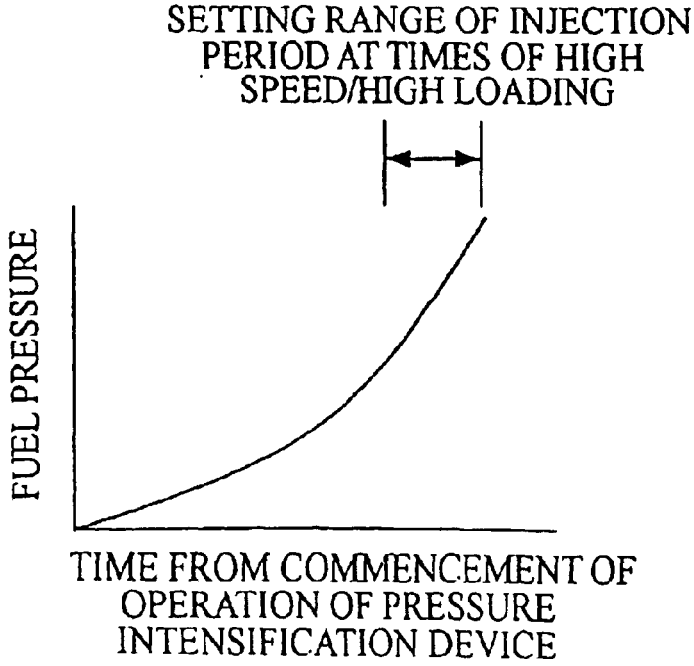
FIG. 3B is a graph showing a relationship of correspondence of time from commencement of a pressure intensifier operation with fuel pressure in the fuel injection device relating to the first embodiment of the present invention.

Accordingly, for example, as shown in FIGS. 3A and 3B, a characteristic in which the rate of rise of the fuel pressure downstream of the pressure intensifier 54 increases with time can be specified.

In other words, when fuel is to be injected, if shape and the like of the protrusion 61 have been specified in accordance with an optimum injection rate of the fuel that is injected from the fuel injection nozzle 34 (for example, an optimum injection rate of a pilot injection, main injection or the like corresponding to engine rotation speed, loading conditions and the like), a fuel injection can be performed at the optimum injection rate when the needle valve 48 is opened and the fuel injection is performed. Moreover, if the structure is set to carry out position control (driving) of the piston control valve 60 using a PZT actuator, a super-magnetostrictive element or the like, lifting speed of the piston control valve 60 can be freely changed, and positional control can be carried out such that movement (lifting) of the piston control valve 60 stops partway through (at an intermediate position). Therefore, it is possible to arbitrarily specify a speed of change of the opening area of the fuel flow path 57 of the cylinder 56; that is, a speed of change of the inflow amount of fuel into the cylinder 56; that is, the speed of pressure intensification of the fuel that is sent to the fuel injection nozzle 34; that is, the injection rate of the fuel that is injected from the fuel injection nozzle 34.

Figure 4:
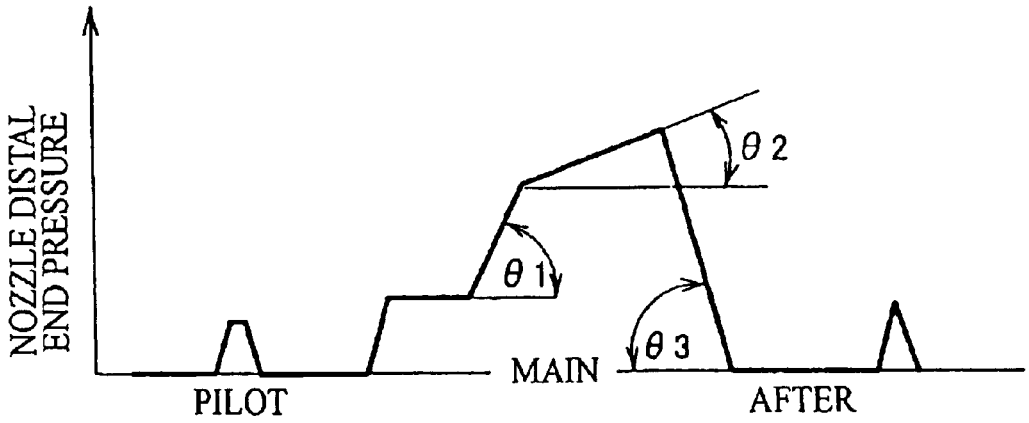
FIG. 4 is a graph showing a representative example of an arbitrary fuel injection pattern which can be performed by the fuel injection device relating to the first embodiment of the present invention.
Figure 5A:
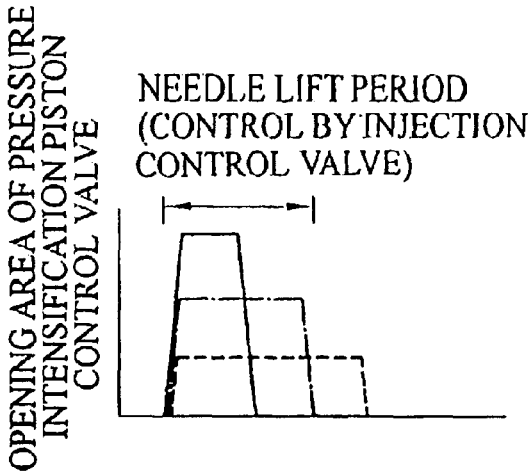
FIG. 5A shows an example of a method for specifying an injection rate by changing a fuel flow path area according to the fuel injection device relating to the first embodiment of the present invention, and is a schematic graph showing changes of an opening area of a pressure intensification piston control valve.
Figure 5B:
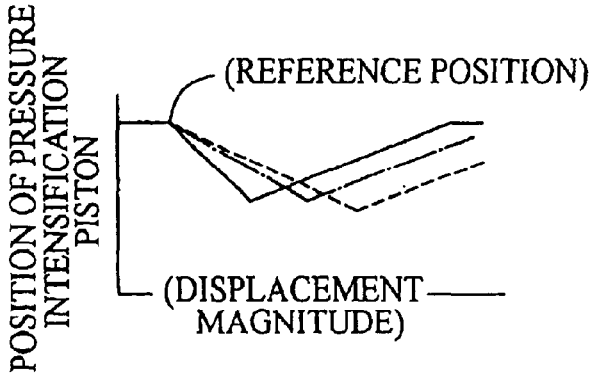
FIG. 5B shows the example of the method for specifying the injection rate by changing the fuel flow path area according to the fuel injection device relating to the first embodiment of the present invention, and is a schematic graph showing changes of a pressure intensification piston position.
Figure 5C:
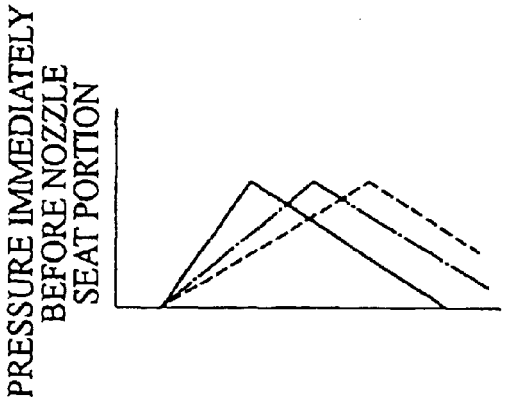
FIG. 5C shows the example of the method for specifying the injection rate by changing the fuel flow path area according to the fuel injection device relating to the first embodiment of the present invention, and is a schematic graph showing changes in pressure immediately before a nozzle seat portion.
Figure 5D:
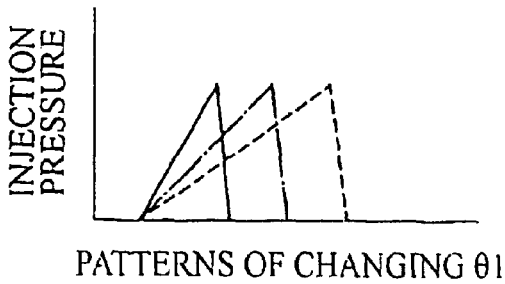
FIG. 5D shows the example of the method for specifying the injection rate by changing the fuel flow path area according to the fuel injection device relating to the first embodiment of the present invention, and is a schematic graph showing changes of injection pressure.
Figure 6A:
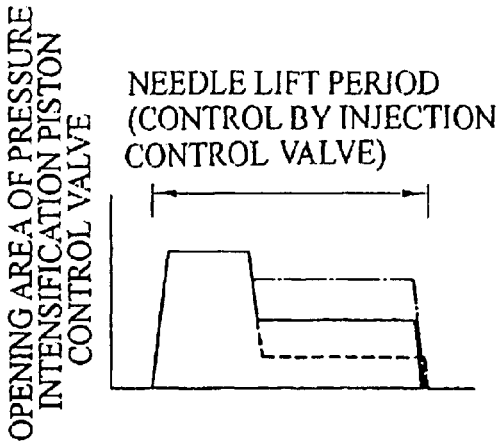
FIG. 6A shows an example of a method for specifying the injection rate by changing the fuel flow path area according to the fuel injection device relating to the first embodiment of the present invention, and is a schematic graph showing changes of the opening area of the pressure intensification piston control valve.
Figure 6B:
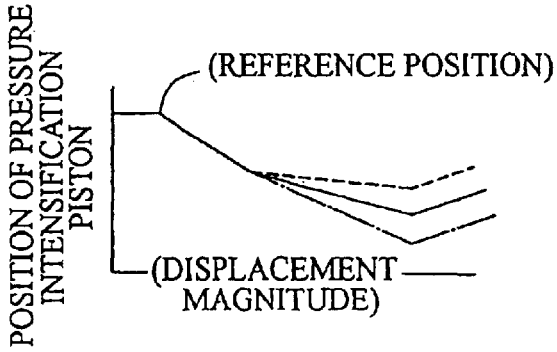
FIG. 6B shows the example of the method for specifying the injection rate by changing the fuel flow path area according to the fuel injection device relating to the first embodiment of the present invention, and is a schematic graph showing changes of the pressure intensification piston position.
Figure 6C:
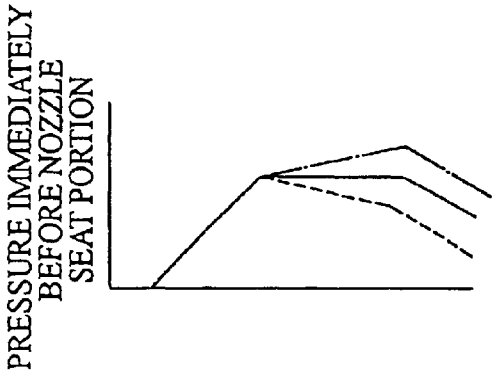
FIG. 6C shows the example of the method for specifying the injection rate by changing the fuel flow path area according to the fuel injection device relating to the first embodiment of the present invention, and is a schematic graph showing changes in the pressure immediately before the nozzle seat portion.
Figure 6D:
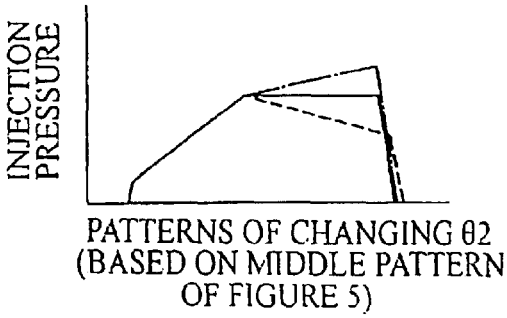
FIG. 6D shows the example of the method for specifying the injection rate by changing the fuel flow path area according to the fuel injection device relating to the first embodiment of the present invention, and is a schematic graph showing changes of the injection pressure.
Figure 7A:
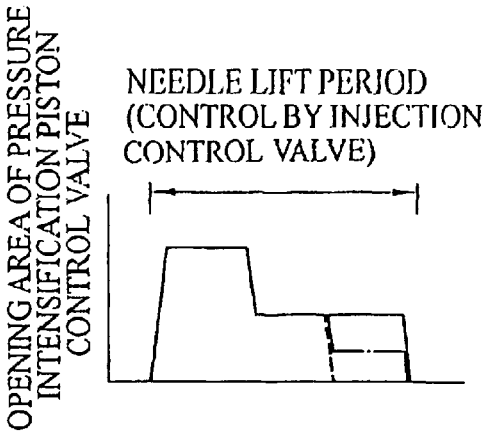
FIG. 7A shows an example of a method for specifying the injection rate by changing the fuel flow path area according to the fuel injection device relating to the first embodiment of the present invention, and is a schematic graph showing changes of the opening area of the pressure intensification piston control valve.
Figure 7B:
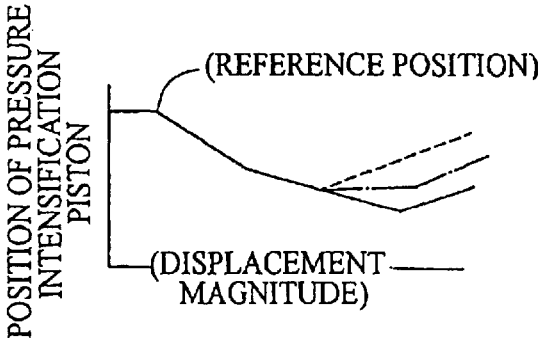
FIG. 7B shows the example of the method for specifying the injection rate by changing the fuel flow path area according to the fuel injection device relating to the first embodiment of the present invention, and is a schematic graph showing changes of the pressure intensification piston position.
Figure 7C:
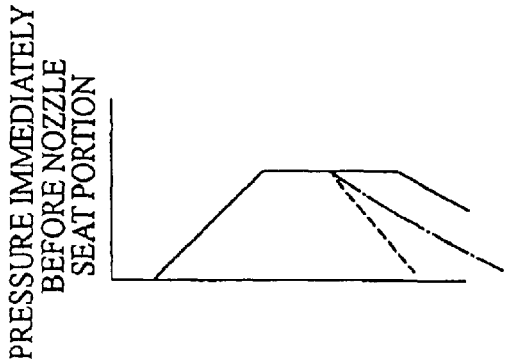
FIG. 7C shows the example of the method for specifying the injection rate by changing the fuel flow path area according to the fuel injection device relating to the first embodiment of the present invention, and is a schematic graph showing changes in the pressure immediately before the nozzle seat portion.
Figure 7D:
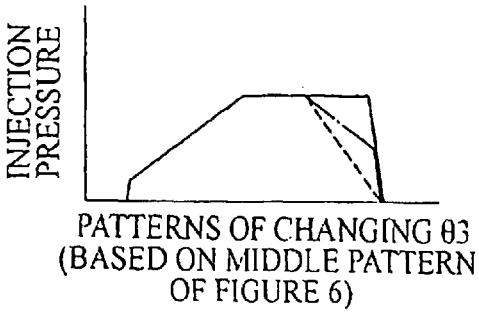
FIG. 7D shows the example of the method for specifying the injection rate by changing the fuel flow path area according to the fuel injection device relating to the first embodiment of the present invention, and is a schematic graph showing changes of the injection pressure.

Thus, for example, in a case in which a multiple injection which carries out a pilot injection, a main injection and an after-injection is carried out, as with the fuel injection pattern shown in FIG. 4, it is possible to freely control (to perform setting or changing) such that a pressure intensification rate after completion of a boot injection period (θ1), a pressure intensification rate immediately before reaching a maximum injection pressure (θ2), a pressure reduction rate at a time of completion of the main injection (θ3) and the like form an optimum fuel injection pattern in accordance with engine rotation speed, loading conditions and the like.

That is, in a case in which a gradient of injection pressure (in particular, for the pressure intensification rate immediately before reaching the maximum injection pressure (θ2) and the pressure reduction rate at the time of completion of the main injection (θ3) of the fuel injection pattern shown in the aforementioned FIG. 4) is changed, whether the injection pressure rises, is constant, or falls is determined by a combination of fuel amounts that are transmitted by the piston 58 and fuel amounts that are ejected by the fuel injection nozzle 34. If fuel amounts transmitted from the piston 58 are greater than fuel amounts that-are ejected, the injection pressure will proceed to rise. If amounts transmitted from the piston 58 are the same as fuel amounts ejected from the fuel injection nozzle 34, the injection pressure is constant. On the other hand, if fuel amounts transmitted from the piston 58 are smaller than fuel amounts that are ejected, the injection pressure will proceed to fall.

Thus, when opening area control is carried out by changing the area of the fuel flow path 57 to the cylinder 56 (the practical opening area of the fuel path) by the piston control valve 60 (the protrusion 61), rates of rise and rates of fall of the injection pressure can be directly changed. Further, a maximum injection pressure changes in accordance with the rate of rise of the injection pressure.

Here, in FIGS. 5 to 7, processes for specifying an injection rate by changing the area of the fuel flow path 57 of the cylinder 56 by the piston control valve 60, in the case in which the multiple injection with the fuel injection pattern shown in the aforementioned FIG. 4 is implemented, is shown in schematic graphs. In this case, FIG. 5 shows a pattern of changing the pressure intensification rate after completion of the boot injection period (θ1), FIG. 6 shows a pattern of changing the pressure intensification rate immediately before reaching the maximum injection pressure (θ2), and FIG. 7 shows a pattern of changing the pressure reduction rate at the time of completion of the main injection (θ3).

Thus, in the fuel injection device 30 relating to this first embodiment, the injection rate of the fuel that is injected from the fuel injection nozzle 34 can be arbitrarily specified (changed) by controlling inflow amounts of liquid fuel (by regulating movement amounts and movement periods (timings) of the piston control valve 60), by changing the area of the fuel flow path 57 to the cylinder 56 (the practical opening area of the flow path) with the piston control valve 60 (a degree of freedom of fuel injection patterns based on injection rates of the fuel is expanded).

Further, in particular, with this fuel injection device 30, it is a structure which changes the area of the fuel flow path 57 of the cylinder 56 by the piston control valve 60, changes inflow amounts of the fuel into the cylinder 56, and changes the movement speed (displacement speed) of the piston 58. Therefore, even in a case in which a maximum injection pressure is temporarily low, the rate of increase of the injection pressure can be set higher.

Further yet, although the main injection has been recited for in the above descriptions, control of rates of increase and rates of decrease of the injection pressure and control of pressure is similarly possible for the after-injection, by changing and controlling the fuel flow path area of the cylinder 56 with the piston control valve 60.

By the way, in this case, an amount of an after-injection is usually extremely small in comparison with an amount of a main injection. For example, a fuel amount for one cycle may be 1 to 2 cubic millimeters. In that case, lifting of the needle valve 48 of the fuel injection nozzle 34 may be what is known as a short-choke period, and it is difficult to clearly discriminate whether it is possible to change rates of increase and rates of decrease of injection pressure. However, even in the case of such extremely small injection amounts, it is possible to control pressure of the after-injection by the aforementioned opening area control. What this means is nothing other than that control of rates of increase and rates of decrease of injection pressure is achieved. Further, if the amount of the after-injection is more than or equal to 5% of the main injection amount, this case is commonly known as a split injection. Even in this case of a split injection, similarly to a time of main injection, control of rates of increase, rates of decrease, and maximum injection pressure of the injection pressure is possible, by the aforementioned opening area control.

Thus, according to the fuel injection device 30 relating to this first embodiment, the injection rate of the fuel that is injected from the fuel injection nozzle 34 can be arbitrarily specified (changed) by controlling inflow amounts of the liquid fuel by changing the opening area of the fuel flow path 57 to the cylinder 56 with the piston control valve 60 (the degree of freedom of fuel injection patterns based on injection rates of the fuel is expanded).

Thus, according to this fuel injection device 30, it is a thing which implements the following effects.

Figure 8A:
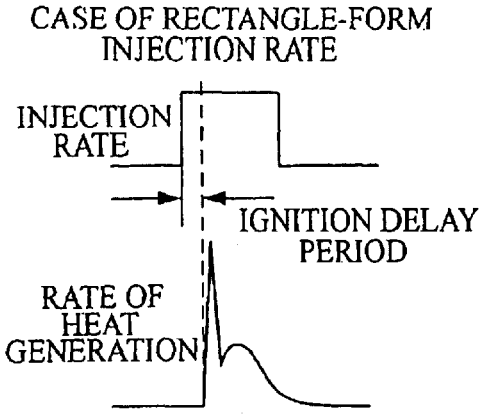
FIG. 8A is a graph showing influences on exhaust and combustion noise caused by a conventional fuel injection device.

(1) Generally, in diesel combustion, as shown in FIG. 8A, a fuel injection has some duration from commencing until ignition (an ignition delay period). In a case in which a fuel injection pattern is a rectangle-form injection rate from a pressure accumulator injection system (common rail injector), a large amount of fuel is injected during the ignition delay period, and this large amount of fuel which is injected during the ignition delay period combusts all at once, consequently leading to increases in NOx and noise.

Figure 8B:
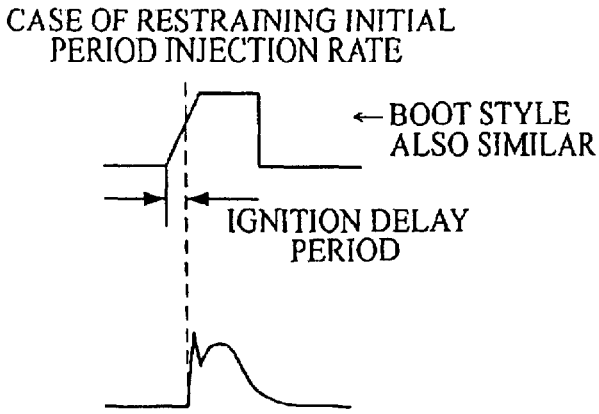
FIG. 8B is a graph showing effects on exhaust and combustion noise caused by the fuel injection device relating to the first embodiment of the present invention.

In contrast, if fuel is injected in a fuel injection pattern in which an initial period injection rate is restrained, as shown in FIG. 8B, by the present fuel injection device 30, favorable combustion in which NOx and noise are low is possible.

Figure 9A:
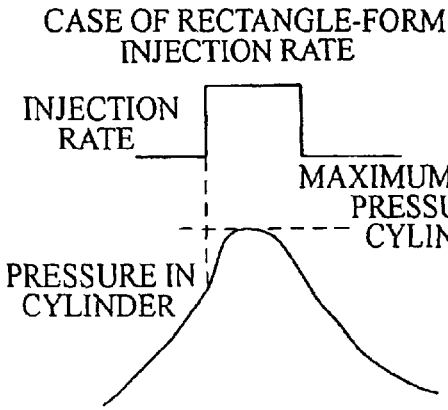
FIG. 9A is a graph showing influences on power output caused by a conventional fuel injection device.

(2) For overall loading conditions of an engine, fuel injection periods and injection amounts are limited by maximum cylinder interior pressure, in order to preserve strength of the engine. Here, in the case in which the fuel injection pattern is a rectangle-form injection rate from the pressure accumulator injection system (the common rail injector), as shown in FIG. 9A, combustion amounts of an initial period are large, and an injection period cannot advance.

Figure 9B:
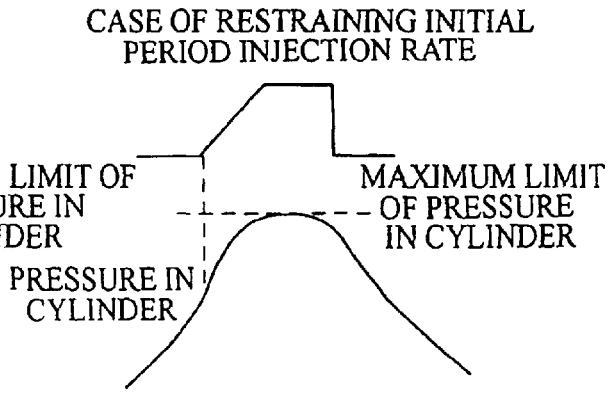
FIG. 9B is a graph showing effects on power output caused by the fuel injection device relating to the first embodiment of the present invention.

In contrast, if a fuel injection pattern in which the initial period injection rate is restrained is set, as shown in FIG. 9B, by the present fuel injection device 30, the injection period can advance, and large amounts of fuel can be injected. Thus, high torque can be obtained. Moreover, NOx and noise can be reduced at this time.

(3) In a case in which a multiple injection is carried out by an ordinary pressure accumulator injection system (common rail injector), the respective injections (a pilot injection, a main injection, an after-injection, a post-injection and the like) are all carried out at the same pressure. However, in actuality, there are respective optimum pressures for the injections. With fuel injection by the present fuel injection method, in a case in which a multiple injection is carried out, each injection can be respectively optimal. Thus, exhaust characteristics are improved and noise is lowered.

For example, if pressure of a pilot injection is too high, problems of an increase in uncombusted hydrocarbons, due to wall surface adhesion of the fuel, and fuel dilution and the like occur. Further, control characteristics at times of injection of very small amounts are worse and, at near-pilot injection times, the pilot combustion is more intense and noise-reduction effects are not sufficiently obtained, and there are other problems. Conversely, if the pressure of a pilot injection is too low, a decrease in noise-reduction effects, due to a deterioration of atomization, an increase in smoke and the like are problems.

In contrast, in the present fuel injection device 30, because the pressure of a pilot injection can be specified separately and independently from a main injection, the effects of the pilot injection are improved.

Figure 10A:
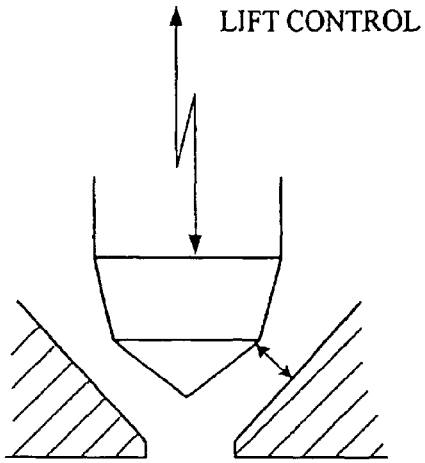
FIG. 10A is a sectional view showing structure of a piston control valve with an ordinary flat seat form.
Figure 10B:
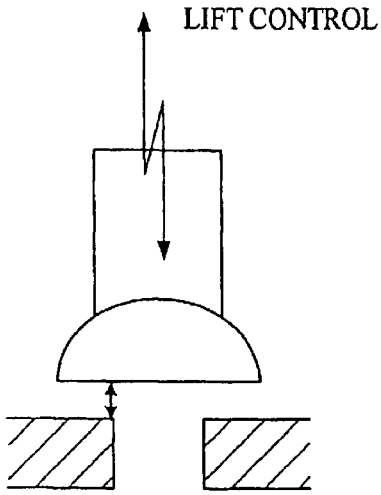
FIG. 10B is a sectional view showing structure of a piston control valve with an ordinary flat seat form.

Further, here, ordinarily, something with a flat seat form is known to serve as a valve form of a piston control valve, as shown in FIG. 10A or FIG. 10B, and an effective flow path cross-sectional area thereof is regulated by a valve seat portion. That is, a control valve with this flat seat form is a structure which regulates the cross-sectional area at the valve seat portion by controlling a lift amount (movement amount) of the valve ("seat portion area control").

In contrast, in the fuel injection device 30 relating to this first embodiment, rather than regulating the cross-sectional area at the valve seat portion as described above (seat portion area control), the protrusion 61 changes the area of the fuel flow path 57 in accordance with movement of the piston control valve 60. That is, the protrusion 61 is provided at the piston control valve 60 to be present in the fuel flow path 57 (the orifice), and is a structure which possesses the "fuel flow path area variability function", which changes the area of the fuel flow path 57 by the position of the protrusion 61 being changed in accordance with the movement amount (lift amount) of this piston control valve 60 ("orifice control").

Accordingly, in something with an ordinary structure which regulates cross-sectional area at a valve seat portion as mentioned above (seat portion area control), the cross-sectional area at the valve seat portion changes linearly in accordance with lift amounts (movement amounts) of the valve. In contrast, in the fuel injection device 30 relating to this first embodiment, by variously suitably specifying the form of the aforementioned protrusion 61, changes in the area of the fuel flow path 57 in accordance with movement amounts (lift amounts) of the piston control valve 60 can be freely specified. Thus, it is possible to arbitrarily specify the injection rate of the fuel that is injected from the fuel injection nozzle 34, and fuel injection patterns can be realized with an extremely high degree of freedom.

Therefore, with the fuel injection device 30 relating to this first embodiment, the following distinctive excellent effects are implemented.

1) An Improvement of Setting Accuracy of Injection Pressure

Figure 11:
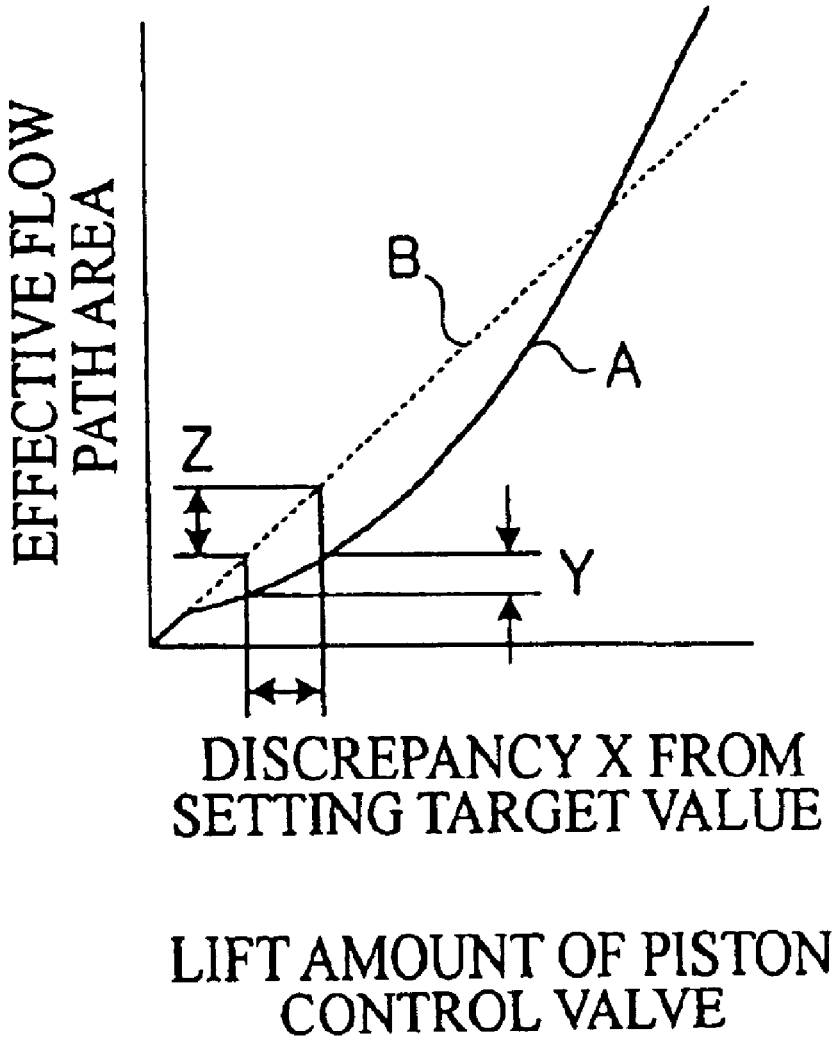
FIG. 11 is a graph showing a relationship of correspondence of movement amount of the piston control valve with effective flow path area in the fuel injection device relating to the first embodiment of the present invention, in comparison with convention.

Something with an ordinary structure which regulates cross-sectional area at a valve seat portion as described above (seat portion area control) is, as shown by line B in FIG. 11, a structure which linearly changes the cross-sectional area at the valve seat portion in accordance with lift amounts (movement amounts) of the valve, and a setting accuracy of the lift amount of the valve is equivalent to the setting accuracy of the cross-sectional area at the valve seat portion (the setting accuracy of the cross-sectional area at the valve seat portion principally depends on the setting accuracy of the lift amount of the valve).

Here, the present applicant has obtained a finding, by simulations, that when fuel is to be injected by a pressure intensifier injection system (jerk injector), in a case of injecting at an injection pressure which is slightly higher than the pressure of the fuel which is flowed into the cylinder 56 of the pressure intensifier 54 by the piston control valve 60 (an operation pressure of the pressure intensifier 54, that is, the common rail pressure), setting accuracy of the injection pressure can be made higher if the fuel inflow amount to the cylinder 56 of the pressure intensifier 54 is made smaller than an inflow amount due to opening of the valve of the ordinary structure. Accordingly, in such a case, as shown by line A in FIG. 11, a discrepancy of a fuel flow path area can be made smaller in relation to a discrepancy X from a setting target value of the movement amount (lift amount) of the piston control valve 60 (relative to a discrepancy amount Z of the valve of the ordinary structure, this is a discrepancy amount Y in the present embodiment, and $Y<Z$) by setting a relationship of the area of the fuel flow path 57 with respect to the movement amount (lift amount) of the piston control valve 60 to a configuration in which the smaller movement amounts are (times at which lift amounts are small), the smaller changes of the area of the fuel flow path 57 become. In other words, breadth of a setting target value of the movement amount (lift amount) of the piston control valve 60 in relation to the fuel flow path area that is to be obtained is widened. That is, even if the movement amount (lift amount) of the piston control valve 60 is discrepant to a certain extent from the setting target value, an effect on the fuel flow path area is slight. Therefore, setting accuracy of the injection pressure (the fuel flow path area of the piston control valve 60) can be raised.

2) An Improvement in Durability of the Valve Seat Portion

In something with an ordinary structure that regulates cross-sectional area at a valve seat portion as described above (seat portion area control), (the opening of) the valve seat portion is a minimum flow path area. Here, in a thing with such a structure, at times of non-operation of this valve (when seated at the valve seat portion), pressure at an upstream side of the seat portion is an operational pressure thereof (that is, the common rail pressure), and the seat portion downstream side (the large bore side of the piston of the pressure intensifier) is at, for example, atmospheric pressure. When, from this state, this valve is operated and fuel is flowed in to the large bore side of the piston of the pressure intensifier (a first chamber of the cylinder), a pressure difference between before and after the seat portion (the seat portion upstream side and downstream side), is largest immediately after this valve has been operated (that is, the operational pressure minus atmospheric pressure). When the pressure difference is thus large, cavitation tends to occur. Because this cavitation occurs at the valve seat portion, this portion is corroded, leading to seating failures. Such seating failures are a serious and fatal problem which impairs the pressure intensification function of the device.

In contrast, in the fuel injection device 30 relating to this first embodiment, the form of the protrusion 61 of the piston control valve 60 is appropriately specified and, when the movement amount (lift amount) of the piston control valve 60 is small, the area of the fuel flow path 57 can be structured so as to be even smaller than the opening area (the minimum flow path area) of the valve seat portion (the fuel flow path 57). Accordingly, a resulting pressure difference between before and after the valve seat portion (the seat portion upstream side and downstream side) can be made smaller, and the occurrence of cavitation can be prevented, even immediately after this piston control valve 60 has been operated. Therefore, corrosion of members caused by cavitation that occurs at the valve seat portion can be prevented, and reliability and durability are greatly improved.

Figure 12A:
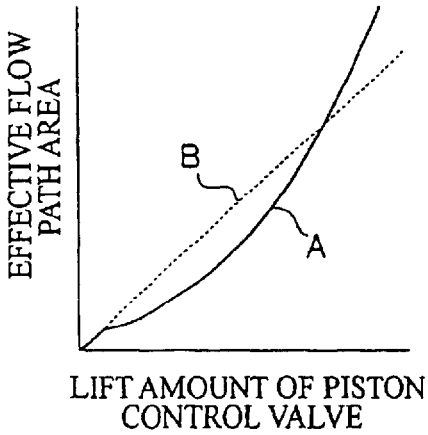
FIG. 12A is a graph showing a setting example of a relationship of correspondence of the movement amount of the piston control valve with the effective flow path area in the fuel injection device relating to the first embodiment of the present invention, in comparison with convention.
Figure 12B:
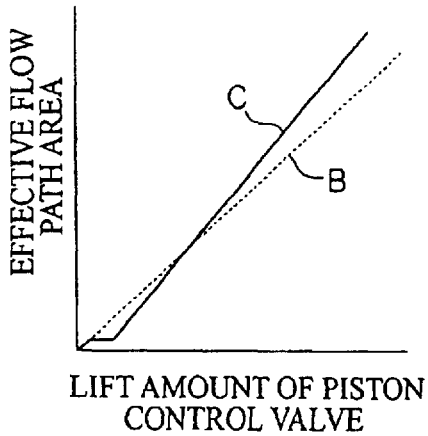
FIG. 12B is a graph showing a setting example of a relationship of correspondence of the movement amount of the piston control valve with the effective flow path area in the fuel injection device relating to the first embodiment of the present invention, in comparison with convention.

Here, in FIGS. 12A and 12B, specification examples of the relationship between movement amount (lift amount) of the piston control valve 60 and fuel flow path area according to the protrusion 61 are shown. In each drawing, line B is a thing of an ordinary structure which regulates the cross-sectional area at the valve seat portion. Further, at line A of FIG. 12A, a specification example which changes the area of the fuel flow path 57 smoothly with movement (lifting) of the piston control valve 60 is shown. At line C of FIG. 12B, a specification example is shown which is provided with a region, when the movement amount (lift amount) of the piston control valve 60 is small, in which (in a certain range) the area of the fuel flow path 57 is held constant. By setting such configurations, the area of the fuel flow path 57 in an initial period of movement of the piston control valve 60, in which cavitation tends to occur, can be prevented from becoming the same as the opening area (the minimum flow path area) of the valve seat portion (a configuration so as to make it even smaller is possible). Thus, the occurrence of cavitation can be prevented, even immediately after this piston control valve 60 has been operated, corrosion of members caused by cavitation that occurs at the valve seat portion can be prevented, and reliability and durability are greatly improved.

3) A Reduction of Volume of the Cylinder 56 of the Large-Bore Piston 58 Side of the Pressure Intensifier 54 (a Reduction in Size)

The fuel injection device 30 relating to this first embodiment is a structure in which the protrusion 61 is provided at the piston control valve 60 so as to be present in the fuel flow path 57 (the orifice). Therefore, the volume of the cylinder 56 of the large-bore piston 58 side of the pressure intensifier 54 (in FIG. 2, the volume formed at the upper side of the large-bore piston 58) can be lowered (a reduction in size).

As recited in "2) An improvement in durability of the valve seat portion" above, in a case which is structured such that the area of the fuel flow path 57 becomes extremely small when the movement amount (lift amount) of the piston control valve 60 is small, if the volume of the cylinder 56 of the large-bore piston 58 side of the pressure intensifier 54 is temporarily large, a rise in pressure in this volume of the cylinder 56 may become excessively slow. With regard thereto, because the volume of the cylinder 56 can be reduced by the protrusion 61 provided at the piston control valve 60, even if the area of the fuel flow path 57 is set to be considerably smaller in order to prevent cavitation at the valve seat portion, an appropriate rise in pressure in this volume of the cylinder 56 can be obtained.

4) Reductions of NOx and Noise, and Raising of Power Output

In the fuel injection device 30 relating to this first embodiment, by favorably setting the relationship between the movement amount (lift amount) of the piston control valve 60 and the fuel flow path area according to the protrusion 61 as described above, a history of a rise in fuel pressure of the pressure intensifier 54 in relation to crank angle of the engine can be arbitrarily specified. Further, by controlling a phase difference between operation of the piston control valve 60 and the injection control valve 52 (by controlling a timing (period) at which the piston control valve 60 is operated and a timing at which the injection in which the injection control valve 52 is operated commences), NOx and noise can be reduced, and higher power output can be anticipated.

Figure 13A:
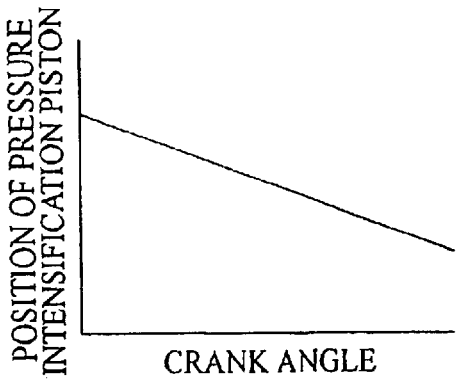
FIG. 13A is a graph showing a relationship of piston position of a pressure intensifier with respect to crank angle, in order to explain the point of implementing further effect by controlling a phase difference between operation of the piston control valve and an injection control valve in the fuel injection device relating to the first embodiment of the present invention.
Figure 13B:
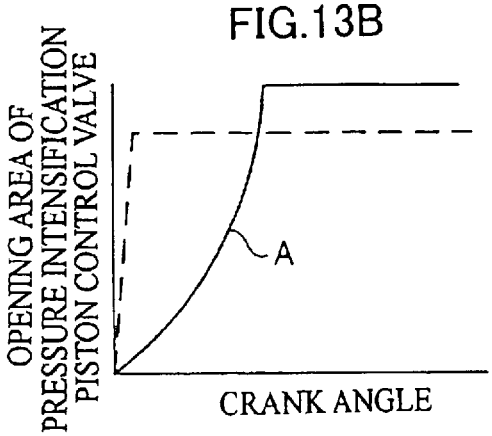
FIG. 13B is a graph showing a relationship of opening area of a pressure intensification piston control valve with respect to crank angle, in order to explain the point of implementing further effect by controlling the phase difference between operation of the piston control valve and the injection control valve in the fuel injection device relating to the first embodiment of the present invention.
Figure 13C:
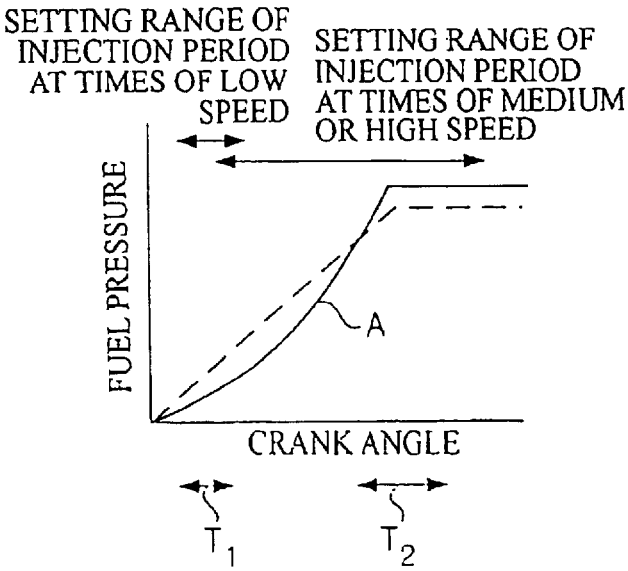
FIG. 13C is a graph showing a relationship of fuel pressure with respect to crank angle, in order to explain the point of implementing further effect by controlling the phase difference between operation of the piston control valve and the injection control valve in the fuel injection device relating to the first embodiment of the present invention.

That is, as shown in FIG. 13A, even if a relationship of "crank angle and position of the piston 58 of the pressure intensifier 54" is the same for both the control valve of an ordinary structure which regulates cross-sectional area and the piston control valve 60 relating to this first embodiment, with the piston control valve 60 relating to this first embodiment, it can be set to a characteristic in which the opening area of the fuel flow path 57 increases gradually in relation to the crank angle, as shown by line A in FIG. 13B, by suitably specifying the form of the protrusion 61. Therefore, as shown by line A in FIG. 13C, the history of the rise in the fuel pressure of the pressure intensifier 54 can be set to a characteristic which gradually increases in relation to the crank angle of the engine.

Figure 13D:
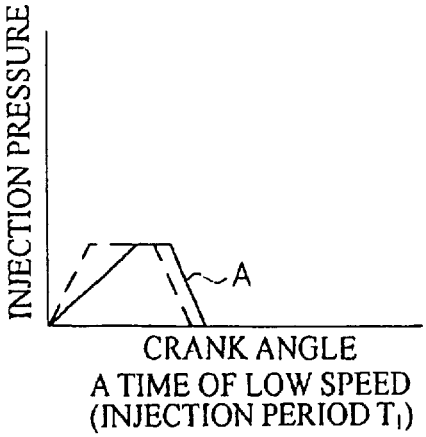
FIG. 13D is a graph showing a relationship of injection pressure with respect to crank angle, in order to explain the point of implementing further effect by controlling the phase difference between operation of the piston control valve and the injection control valve in the fuel injection device relating to the first embodiment of the present invention.
Figure 13E:
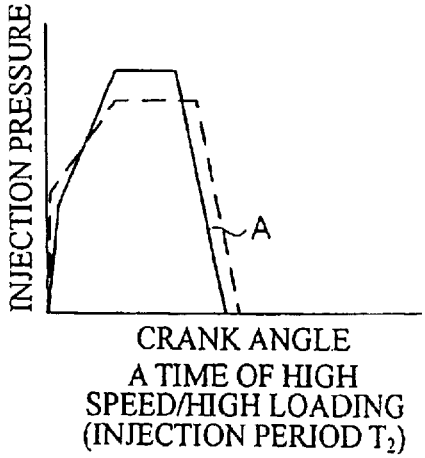
FIG. 13E is a graph showing a relationship of injection pressure with respect to crank angle, in order to explain the point of implementing further effect by controlling the phase difference between operation of the piston control valve and the injection control valve in the fuel injection device relating to the first embodiment of the present invention.

Here, by controlling the period in which the piston control valve 60 is operated and the timing at which the injection in which the injection control valve 52 is operated commences as described above, if the injection control valve 52 is operated with, for example, a timing $T_1$ at times of lower speed, as shown by line A in FIG. 13D, a fuel injection in which the injection rate of an initial period is lowered can be performed, and NOx and noise can be lowered. Further, if the injection control valve 52 is operated with, for example, a timing $T_2$ at times of high speed, times of high loading and the like, as shown by line A in FIG. 13E, injection with an excessive injection period can be suppressed, and higher power output can be anticipated.

By the way, in FIGS. 13A to 13E, characteristics of a control valve of an ordinary structure which regulates cross-sectional area are shown by broken lines.

As described above, with the fuel injection device 30 relating to this first embodiment, fuel can be injected by a very high injection pressure which is significantly higher in comparison to convention, and favorable combustion and exhaust characteristics can be realized without a maximum injection pressure being determined principally by the fuel pressure of the pressure accumulator 32. Moreover, it is possible to carry out fuel injections with arbitrary fuel injection patterns (the degree of freedom of fuel injection patterns based on injection rates of the fuel is expanded).

Next, another embodiment of the present invention will be described. By the way, components that are basically the same as in the first embodiment are assigned the same reference numerals as in the first embodiment, and descriptions thereof are omitted.

[Second Embodiment]

Figure 14:
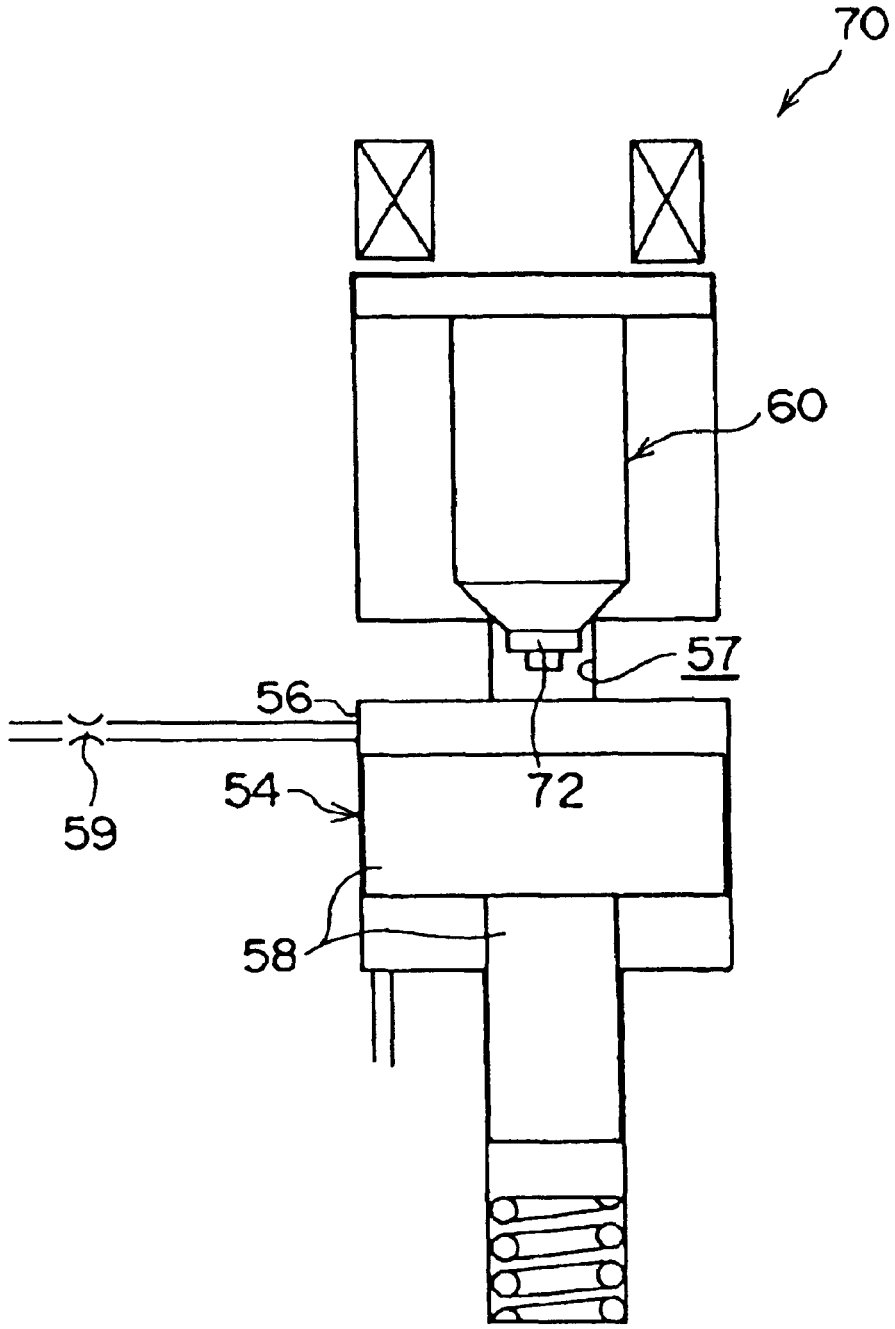
FIG. 14 is a structural view of a principal portion of a fuel injection device relating to a second embodiment of the present invention.

In FIG. 14, structure of a principal portion of a fuel injection device 70 relating to a second embodiment of the present invention is shown.

In the fuel injection device 70, a protrusion 72, which serves as the flow amount-changing means, is provided at a distal end portion of the piston control valve 60. This protrusion 72 is set to a two-step stepped form, and is a structure which can change the practical opening area of the fuel flow path 57 of the cylinder 56 in accordance with movement of the piston control valve 60. Thus, inflow amounts of the liquid fuel that is flowed into the cylinder 56 by the piston control valve 60 can be controlled.

Figure 15A:
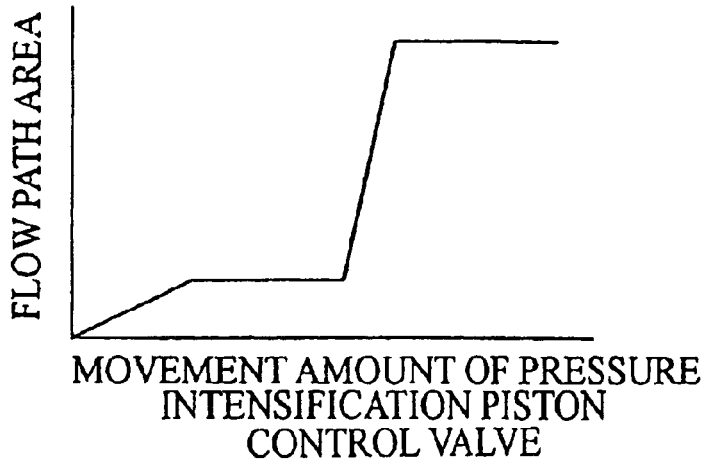
FIG. 15A is a graph showing a relationship of correspondence of movement amount of a piston control valve with flow path area in the fuel injection device relating to the second embodiment of the present invention.
Figure 15B:
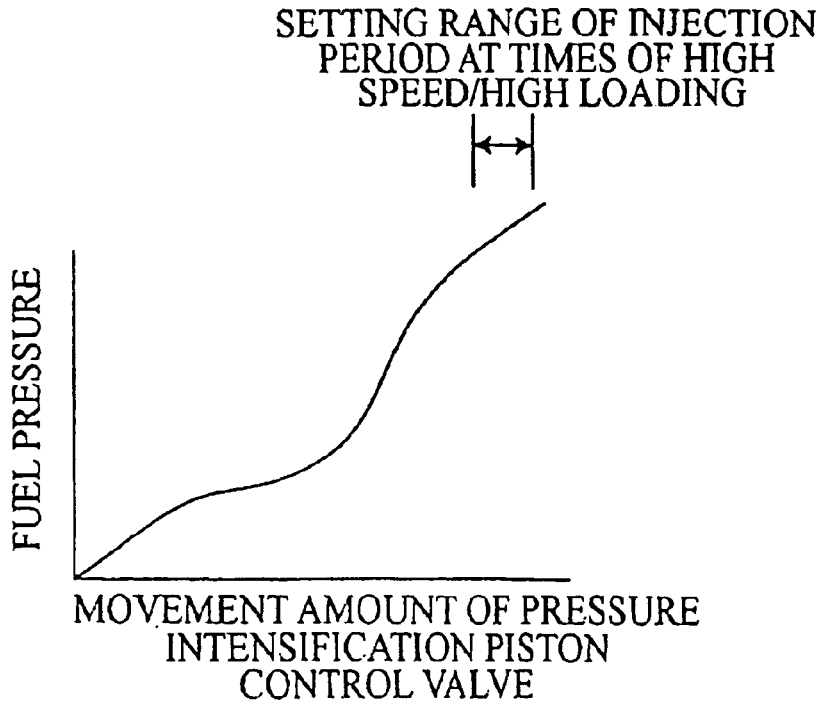
FIG. 15B is a graph showing a relationship of correspondence of the movement amount of the piston control valve with fuel pressure in the fuel injection device relating to the second embodiment of the present invention.

In the fuel injection device 70, as shown in FIGS. 15A and 15B, a rate of rise of the fuel pressure downstream of the pressure intensifier 54 can be set to a characteristic which increases with time. Therefore, similarly to the fuel injection device 30 relating to the first embodiment described above, it is possible to arbitrarily specify injection rates of the fuel that is injected from the fuel injection nozzle 34, and similar effects to the fuel injection device 30 relating to the first embodiment are implemented.

[Third Embodiment]

Figure 16:
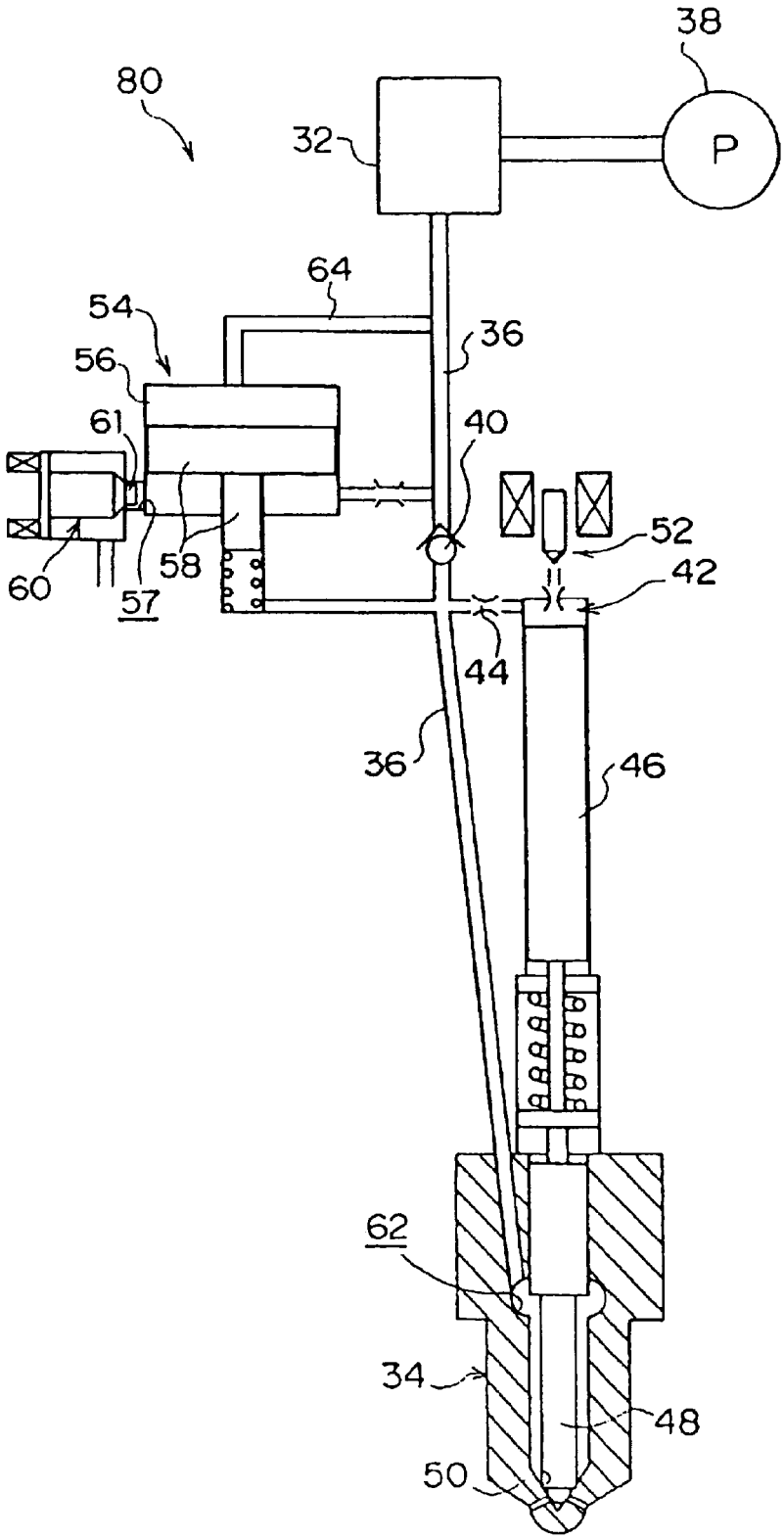
FIG. 16 is an overall structural view of a fuel injection device relating to a third embodiment of the present invention.

In FIG. 16, overall structure of a fuel injection device 80 relating to a third embodiment of the present invention is shown.

In the fuel injection device 80, concerning the piston control valve 60, it is provided to correspond to the piston 58 of the small bore side of the pressure intensifier 54, the piston 58 is moved by flowing out liquid fuel in the cylinder 56, and this is a structure which can obtain an increase of fuel pressure at the downstream side relative to the pressure-blocking valve 40.

That is, in the first and second embodiments described above, concerning the piston control valve 60, it is a structure which arbitrarily specifies (changes) injection rates of the fuel that is injected from the fuel injection nozzle 34 by controlling inflow amounts of the liquid fuel, by changing the practical opening area of the fuel flow path 57 to the cylinder 56. However, with the fuel injection device 80 relating to the third embodiment, concerning the piston control valve 60, it is structured so as to control outflow amounts of liquid fuel from the cylinder 56, by changing the opening area of a fuel flow path of the cylinder 56 (an outflow path), and is thus a structure which can arbitrarily specify (change) injection rates of the fuel that is injected from the fuel injection nozzle 34.

In this case too, various fuel injection patterns can be specified similarly to the first and second embodiments, and the same operations and effects are implemented.

[Fourth Embodiment]

Figure 17:
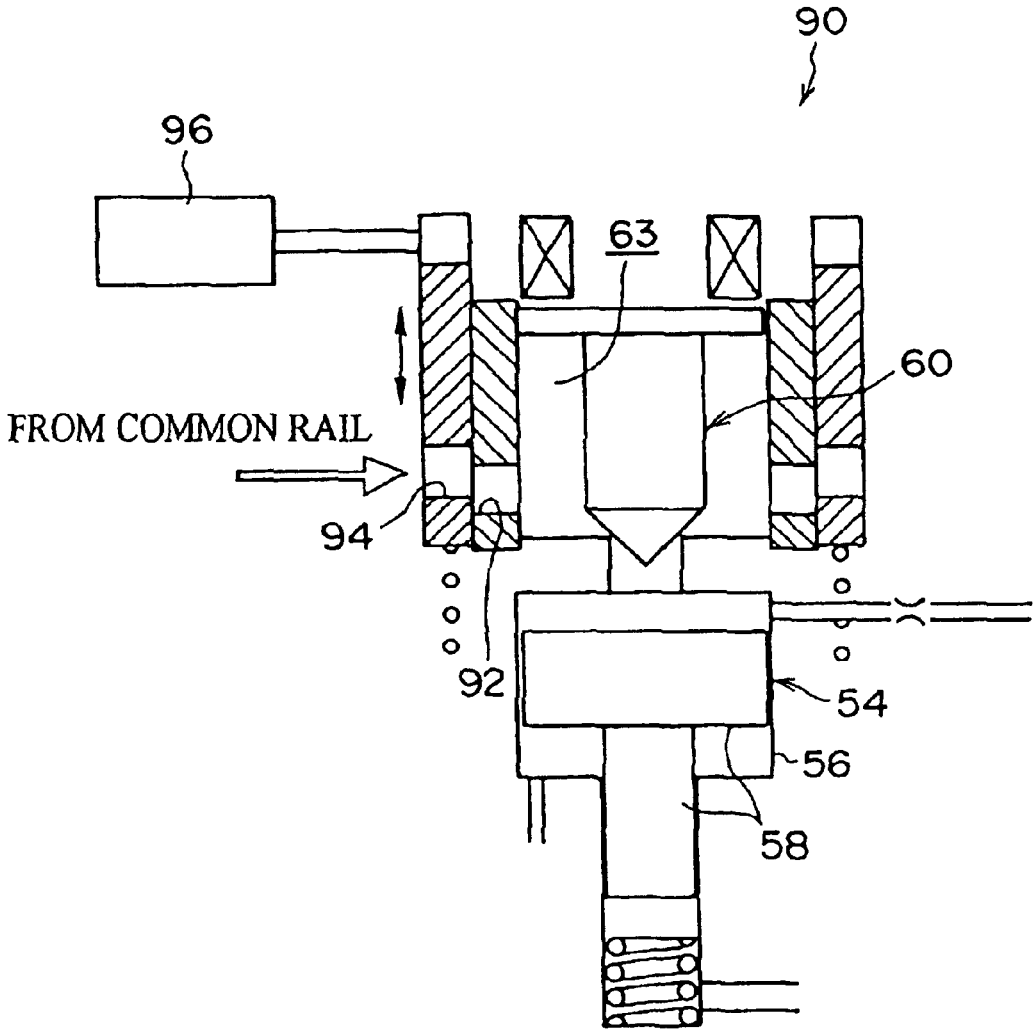
FIG. 17 is a structural view of a principal portion of a fuel injection device relating to a fourth embodiment of the present invention.

In FIG. 17, structure of a principal portion of a fuel injection device 90 relating to a fourth embodiment of the present invention is shown.

In the fuel injection device 90, concerning the piston control valve 60, a fixed orifice 92 and a movable orifice 94 are provided to serve as the flow amount-changing means. This fixed orifice 92 communicates with a fuel chamber 63 of the piston control valve 60. Further, the movable orifice 94 is provided to overlap and communicate with an outer periphery of the fixed orifice 92, and moreover, is a structure which can change the degree of overlap with the fixed orifice 92 by moving. Further, the movable orifice 94 is connected to an engine governor 96, which serves as moving means, and is structured such that fuel pressure with a second power of the engine rotation speed is effected for moving the movable orifice 94.

In this fuel injection device 90, when fuel is to be injected, the movable orifice 94, at which the fuel pressure of the second power of the engine rotation speed is effected by the engine governor 96, is moved. Thus, the degree of overlap of the movable orifice 94 with the fixed orifice 92 is changed, and a practical opening area of this orifice is changed.

Figure 18A:
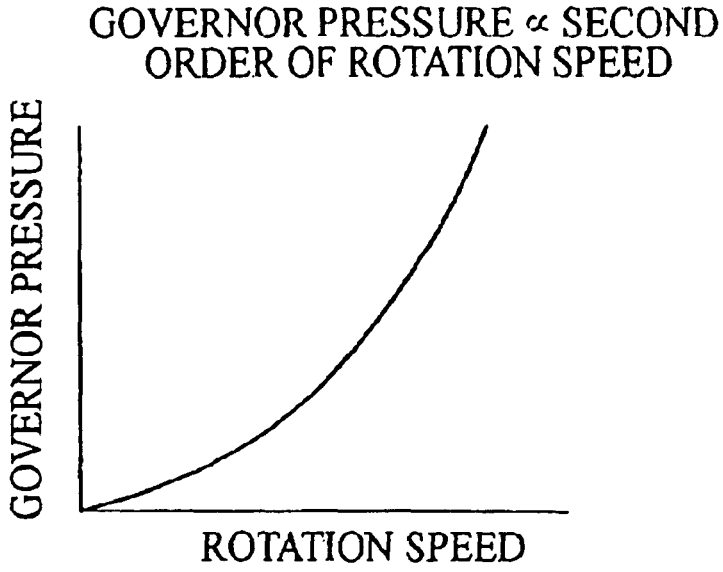
FIG. 18A is a graph showing a relationship of correspondence of engine rotation speed with governor pressure in the fuel injection device relating to the fourth embodiment of the present invention.
Figure 18B:
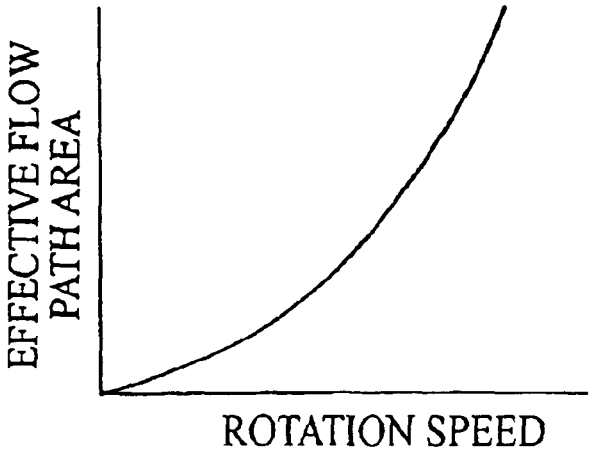
FIG. 18B is a graph showing a relationship of correspondence of engine rotation speed with effective flow path area in the fuel injection device relating to the fourth embodiment of the present invention.

In this case, as shown in FIGS. 18A and 18B, the movement amount of the movable orifice 94 is roughly proportional to the fuel pressure that acts, that is, to the second power of the engine rotation speed. Therefore, the higher the engine rotation speed, the greater the degree of overlap of the movable orifice 94 with the fixed orifice 92 becomes, and the larger the effective opening area of the liquid fuel that flows into the fuel chamber 63 of the piston control valve 60 becomes. Thus, the pressure of the fuel that flows into the cylinder 56 (the rate of rise thereof) is changed by the piston control valve 60, and it is possible to change the movement speed of the piston 58.

In this case, a relationship of effective opening area of this flow path in relation to, for example, engine rotation speed can be freely specified by suitably specifying shapes of the movable orifice 94 and the fixed orifice 92 (for example, rectangular forms, circular forms, trapezoid forms and the like) and changing numbers thereof.

In other words, if the shapes of the fixed orifice 92 and movable orifice 94, and movement speed and the like of the movable orifice 94 are specified by the engine governor 96 and the like in accordance with an optimum injection rate of the fuel that is injected from the fuel injection nozzle 34 (for example, an optimum injection rate of a pilot injection, a main injection or the like in accordance with engine rotation speed, loading conditions and the like), a fuel injection can be performed at the optimum injection rate when the needle valve 48 is opened and the fuel injection is performed. Therefore, fuel injection patterns can be realized with an extremely high degree of freedom.

Thus, in the fuel injection device 90 too, similarly to the fuel injection device 30 relating to the first embodiment described above, it is possible to arbitrarily specify injection rates of the fuel that is injected from the fuel injection nozzle 34, and similar effects to the fuel injection device 30 relating to the first embodiment are implemented.

By the way, in the description above, a structure which carries out control of the movable orifice 94 with fuel pressure utilizing the engine governor 96 has been shown. However, alternatively, this may be a structure which directly controls with a PZT actuator, an electromagnet, or fuel pressure or the like, without utilizing the engine governor 96.

[Fifth Embodiment]

Figure 19:
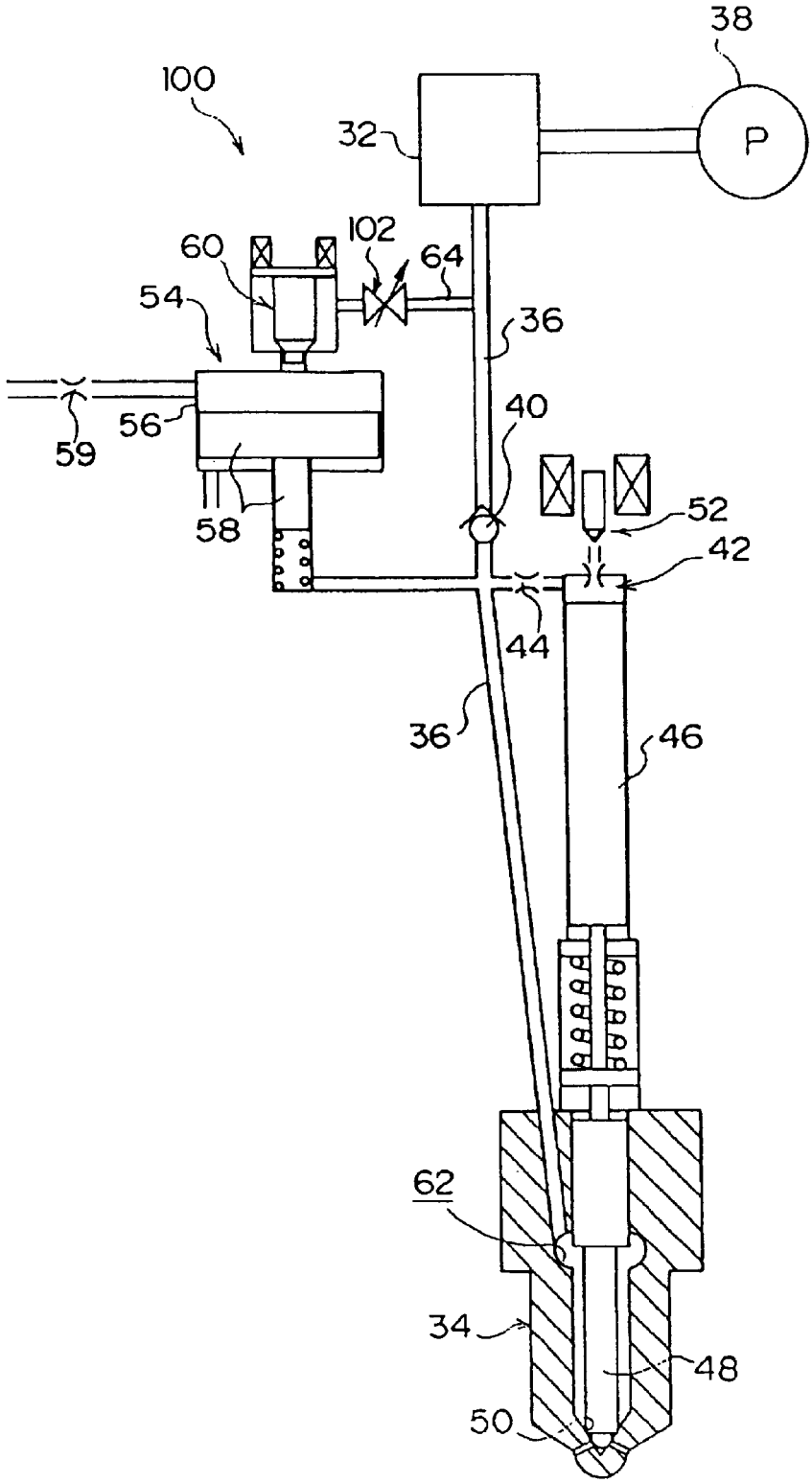
FIG. 19 is an overall structural view of a fuel injection device relating to a fifth embodiment of the present invention.

In FIG. 19, overall structure of a fuel injection device 100 relating to a fifth embodiment of the present invention is shown.

In the fuel injection device 100, a pressure regulator 102, which serves as the flow amount-changing means, is provided at the fuel line 64 from the pressure accumulator 32, at which the piston control valve 60 is provided.

In this fuel injection device 100, when fuel is to be injected, inflow pressure of the fuel to the cylinder 56 is changed by the pressure regulator 102. Thus, movement speed of the piston 58 is changed, and it is possible to arbitrarily specify the injection rate of the fuel that is injected from the fuel injection nozzle 34. Therefore, fuel injection patterns can be realized with an extremely high degree of freedom.

Thus, in the fuel injection device 100 too, similarly to the fuel injection device 30 relating to the first embodiment described above, it is possible to arbitrarily specify injection rates of the fuel that is injected from the fuel injection nozzle 34, and similar effects to the fuel injection device 30 relating to the first embodiment are implemented.

By the way, this is not limited to being a structure in which the pressure regulator 102 is provided at the fuel line 64 from the pressure accumulator 32 and which changes inflow pressure of the fuel to the cylinder 56 as described above, and can be a structure in which this pressure regulator 102 is provided to correspond to the piston 58 of the small bore side of the pressure intensifier 54 (provided at a fuel outflow path from the cylinder 56) and which changes outflow pressure of liquid fuel that is flowed out from in the cylinder 56.

[Sixth Embodiment]

Figure 20:
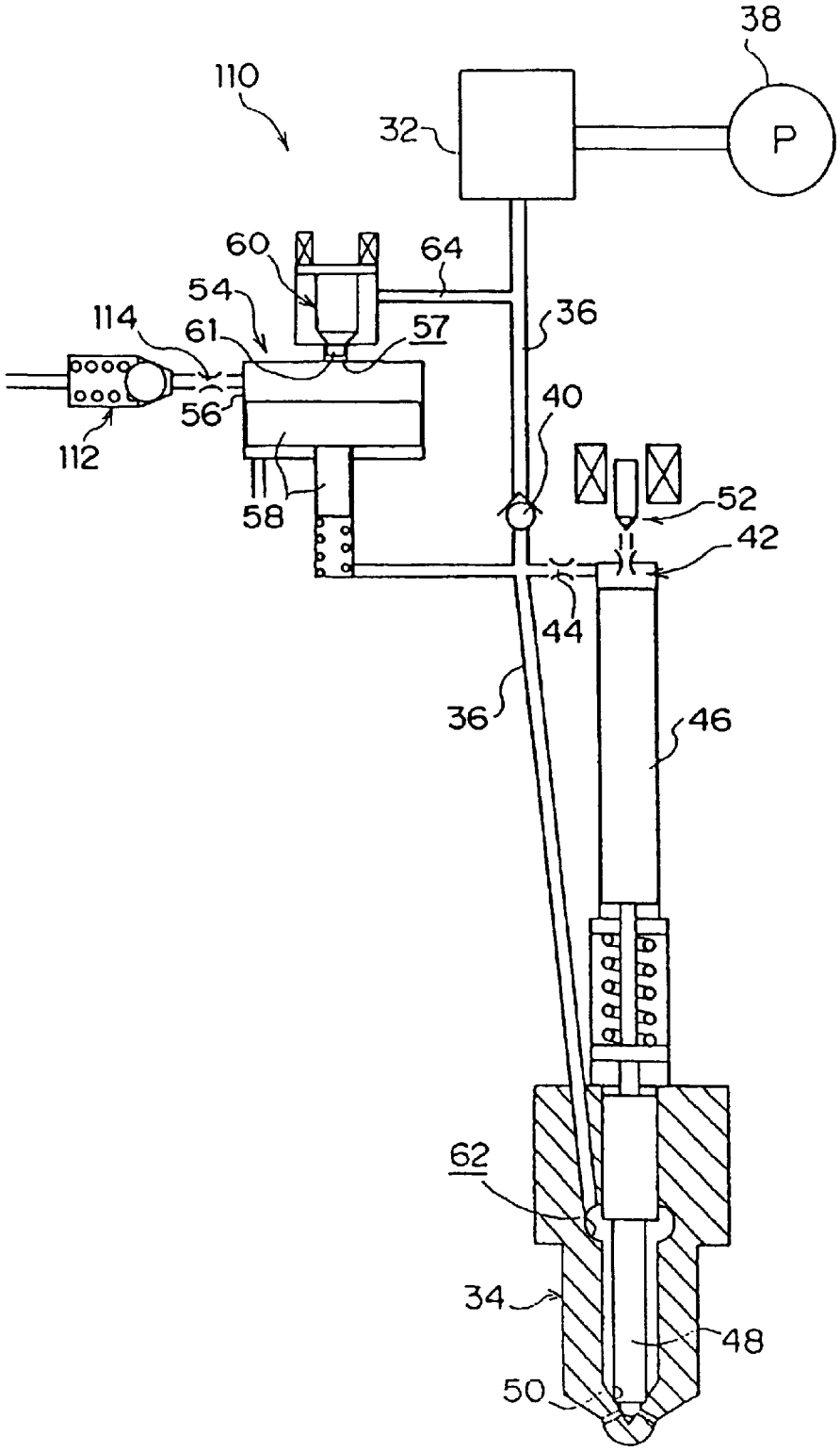
FIG. 20 is an overall structural view of a fuel injection device relating to a sixth embodiment of the present invention.

In FIG. 20, overall structure of a fuel injection device 110 relating to a sixth embodiment of the present invention is shown.

In this fuel injection device 110, at the cylinder 56 of the pressure intensifier 54 at which the piston control valve 60 is provided, a residual pressure regulation valve 112 is provided to serve as residual pressure-regulating means. This residual pressure regulation valve 112 is connected to the cylinder 56 of the large-bore piston 58 side of the pressure intensifier 54, via an orifice 114, and can regulate pressure in the cylinder 56 (the large-bore piston 58 side) to a predetermined pressure at a time of non-operation of the piston control valve 60.

As described above, if the pressure difference between before and after the valve seat portion of the piston control valve 60 (the seat portion upstream side and downstream side) is large, cavitation tends to occur immediately after the piston control valve 60 has been operated.

In regard thereto, in the fuel injection device 110, the pressure in the cylinder 56, of the large-bore piston 58 side of the pressure intensifier 54, can be maintained at the predetermined pressure by the residual pressure regulation valve 112, rather than decreasing to atmospheric pressure. Therefore, (because a residual pressure is conserved), corrosion of members caused by cavitation that occurs at the valve seat portion of the piston control valve 60 can be prevented, and reliability and durability are greatly improved.

By the way, the fuel injection device 110 relating to this sixth embodiment is a structure in which the residual pressure regulation valve 112 is connected to the cylinder 56 via the orifice 114 (a structure in which the residual pressure regulation valve 112 is arranged at a downstream side of the orifice 114), but is not limited to this, and may be a structure in which the residual pressure regulation valve 112 is arranged at an upstream side of the orifice 114.

Further, the fuel injection device 110 relating to this sixth embodiment is a structure in which the piston control valve 60 is a two-way valve-type structure and the residual pressure regulation valve 112 is provided independently from the piston control valve 60, but is not limited to this, and may be a structure in which the residual pressure regulation valve 112 is integrated with the piston control valve 60, that is, the piston control valve 60 being a three-way valve-type structure having a function as a residual pressure regulation valve.

[Seventh Embodiment]

Figure 21:
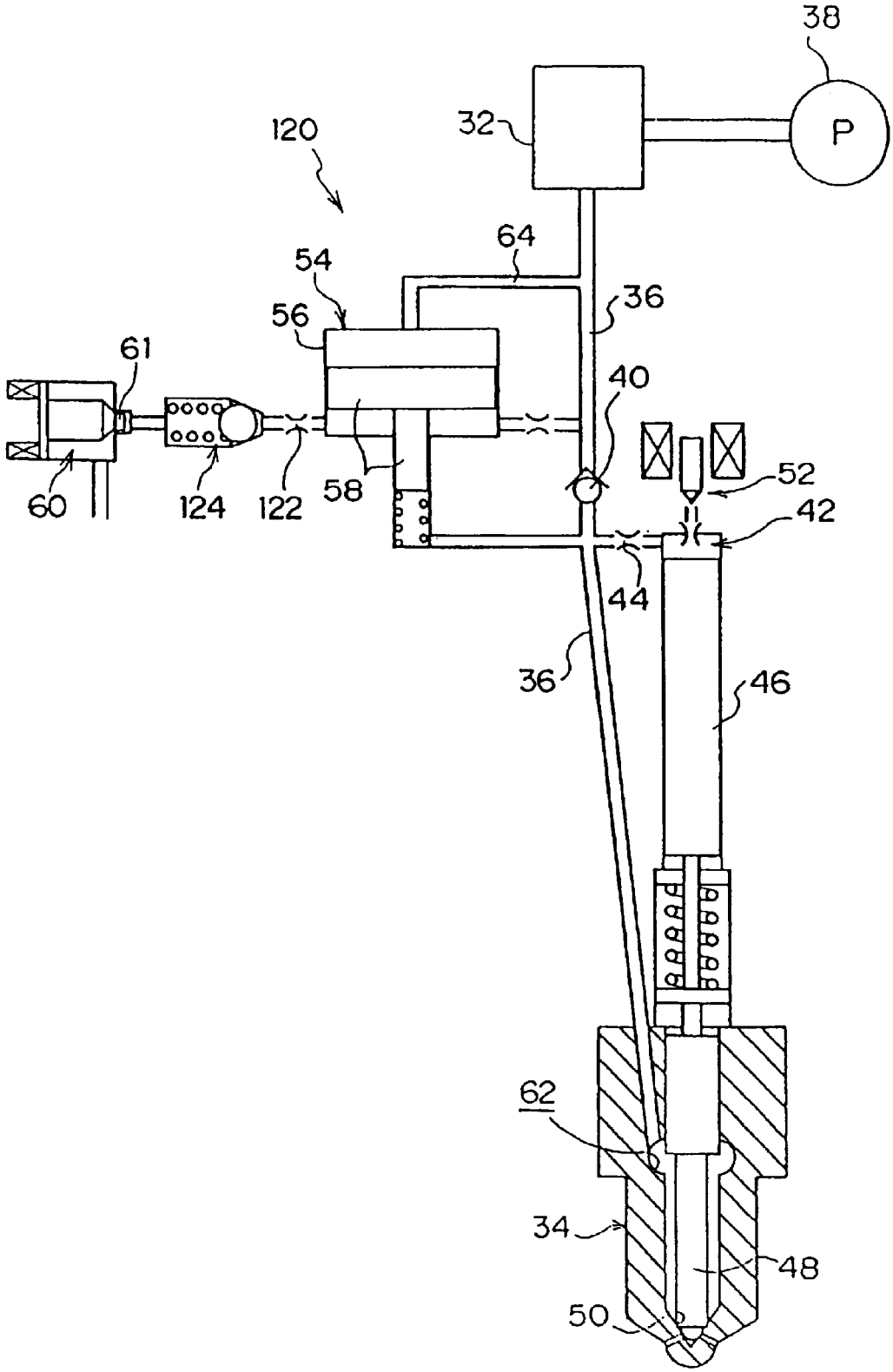
FIG. 21 is an overall structural view of a fuel injection device relating to a seventh embodiment of the present invention.

In FIG. 21, overall structure of a fuel injection device 120 relating to a seventh embodiment of the present invention is shown.

This fuel injection device 120 is a structure which is basically similar to the fuel injection device 80 relating to the third embodiment described above (FIG. 16), but is a structure in which an orifice 122 and a residual pressure regulation valve 124 are provided between the cylinder 56 of the pressure intensifier 54 and the piston control valve 60. Thus, the piston control valve 60 moves the piston 58 by flowing out liquid fuel in the cylinder 56, can obtain an increase in fuel pressure at the downstream side relative to the pressure-blocking valve 40, and can regulate pressure in the cylinder 56 to the predetermined pressure with the residual pressure regulation valve 124 at times of non-operation of the piston control valve 60.

In this fuel injection device 120, the pressure in the cylinder 56 of the pressure intensifier 54 can be maintained at the predetermined pressure by the residual pressure regulation valve 124, rather than decreasing to atmospheric pressure. Therefore (because residual pressure is conserved), corrosion of members caused by cavitation can be prevented, and reliability and durability are greatly improved.

By the way, the fuel injection device 120 relating to this seventh embodiment is a structure in which the residual pressure regulation valve 124 is provided between the cylinder 56 of the pressure intensifier 54 and the piston control valve 60 (a structure in which the residual pressure regulation valve 124 is arranged at an upstream side of the piston control valve 60), but is not limited to this, and may be a structure in which the residual pressure regulation valve 124 is arranged at a downstream side of the piston control valve 60.

Further, the fuel injection device 120 relating to this seventh embodiment is a structure in which the residual pressure regulation valve 124 is connected to the cylinder 56 via the orifice 122 (a structure in which the residual pressure regulation valve 124 is arranged at a downstream side of the orifice 122), but is not limited to this, and may be a structure in which the residual pressure regulation valve 124 is arranged at an upstream side of the orifice 122.

Further, the fuel injection device 120 relating to this seventh embodiment is a structure in which the piston control valve 60 is a two-way valve-type structure and the residual pressure regulation valve 124 is provided independently from the piston control valve 60, but is not limited to this, and may be a structure in which the residual pressure regulation valve 124 is integrated with the piston control valve 60, that is, the piston control valve 60 being a three-way valve-type structure having a function as a residual pressure regulation valve.

[Eighth Embodiment]

Figure 22:
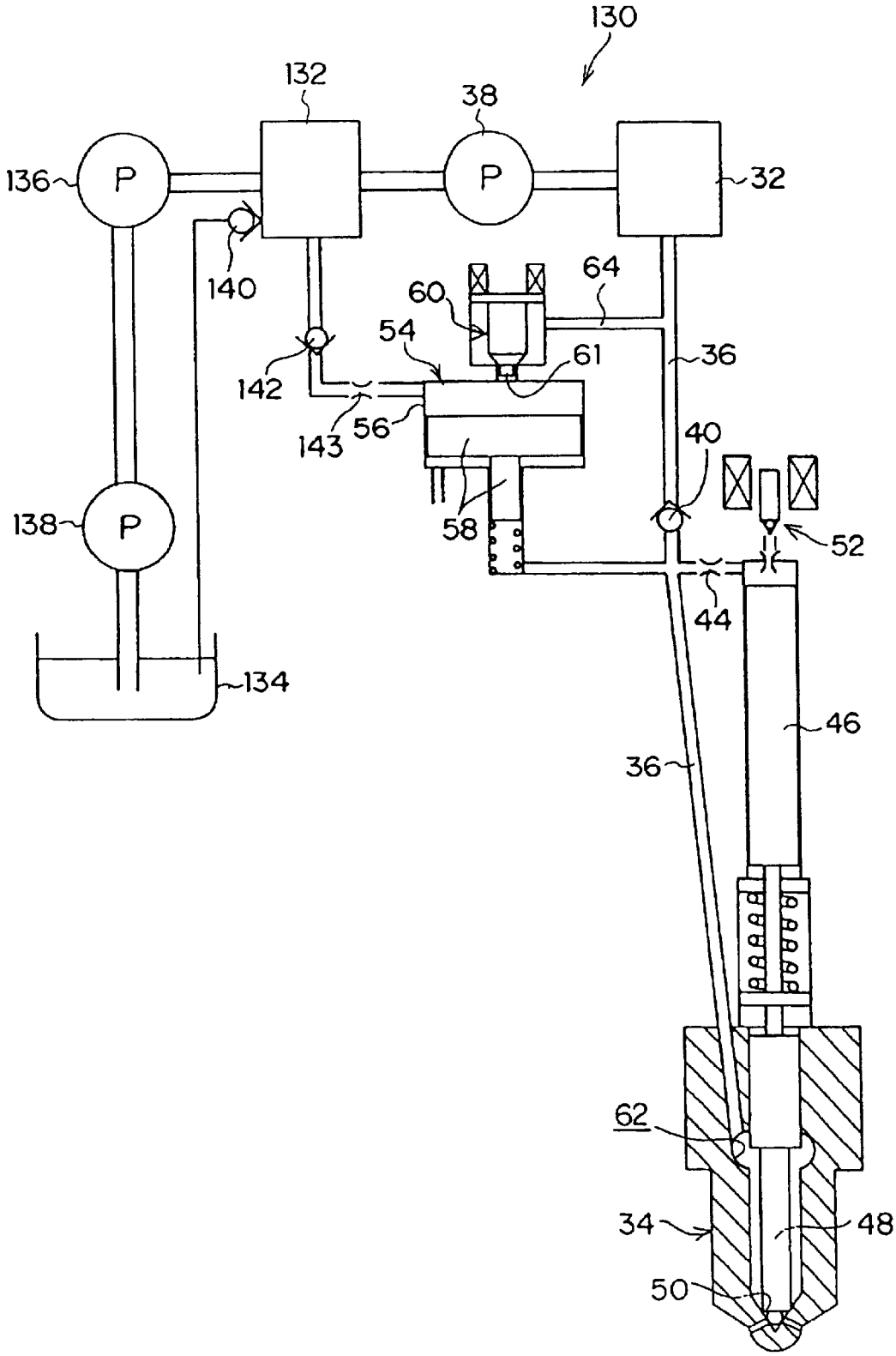
FIG. 22 is an overall structural view of a fuel injection device relating to an eighth embodiment of the present invention.

In FIG. 22, overall structure of a fuel injection device 130 relating to an eighth embodiment of the present invention is shown.

In this fuel injection device 130, resupplying means is provided for supplying fuel, which has been discharged from in the cylinder 56 in accordance with the piston control valve 60 closing and the piston 58 of the pressure intensifier 54 being moved to its original position again, to the fuel pressurization pump 38 again, in preparation for a next fuel injection.

That is, a medium-pressure common rail 132 is arranged at downstream of the fuel pressurization pump 38, and this is a structure at which a medium-pressure supply pump 136 and a feed pump 138 connect from a tank 134 to this medium-pressure common rail 132. Further, a pressure regulation valve 140 is provided at the medium-pressure common rail 132. Further, a residual pressure regulation valve 142, which is connected to the cylinder 56 of the pressure intensifier 54 via an orifice 143, is a structure which is connected to the medium-pressure common rail 132. Thus, fuel that is discharged via the residual pressure regulation valve 142 is returned to the medium-pressure common rail 132.

In this fuel injection device 130, high pressure fuel that has been discharged from the cylinder 56 of the pressure intensifier 54 is not released to the atmosphere but returned to the medium-pressure common rail 132 via the residual pressure regulation valve 142, and is supplied to the fuel pressurization pump 38 again. Therefore, fuel pressure energy can be recovered (re-utilized), and efficiency of the injection system can be raised.

By the way, pressure of the medium-pressure common rail 132 can be maintained at a predetermined pressure by providing a valve with a mechanical structure like the pressure regulation valve 140 at the medium-pressure common rail 132. If this is structured such that pressure of the medium-pressure common rail 132 can be appropriately variable relative to the pressure accumulator (common rail) 32 by implementing, for example, electronic control, residual pressure in the cylinder 56 of the pressure intensifier 54 can be optimally regulated, and efficiency of the injection system can be raised even further.

Further, in the fuel injection device 130 relating to the eighth embodiment, pulsation between inside the cylinder 56 of the pressure intensifier 54 and the medium-pressure common rail 132 can be effectively damped by the residual pressure regulation valve 142 having been provided. On the other hand, structuring to omit the residual pressure regulation valve 142 is also possible.

Further again, the residual pressure regulation valve 142 is not limited to a thing with a mechanical structure as described above, and may be structured as an electrically movable control valve so as to control pressure in the cylinder 56 of the pressure intensifier 54 (or a pressure difference between in the cylinder 56 and the medium-pressure common rail 132). In a structure which electrically controls residual pressure thus, pressure in the cylinder 56 of the pressure intensifier 54 can be controlled in accordance with the pressure of the pressure accumulator (common rail) 32, and efficiency of the injection system can be raised even further.

Further, in the example shown in FIG. 22, the residual pressure regulation valve 142 is shown as being arranged at each respective injector of the engine, but is not limited to this, and may be a structure at which piping (pipelines) from the cylinder 56 of the pressure intensifier 54 of each respective injector are gathered, and the single residual pressure regulation valve 142 is arranged thereat. Consequently, a number of components can be reduced, and a reduction of costs can be anticipated.

Further again, the fuel injection device 130 relating to the eighth embodiment described above is a structure in which the piston control valve 60 and the residual pressure regulation valve 142 are provided to correspond with the piston 58 of the large-bore side of the pressure intensifier 54, but is not limited to this, and may be a structure in which this piston control valve 60 and residual pressure regulation valve 142 are provided to correspond with the piston 58 of the small bore side of the pressure intensifier 54, like the fuel injection device 120 relating to the seventh embodiment shown in FIG. 21, the piston 58 is moved by the liquid fuel in the cylinder 56 being flowed out, and the high-pressure fuel that has been discharged from the cylinder 56 is returned to the medium-pressure common rail 132.

[Ninth Embodiment]

Figure 23:
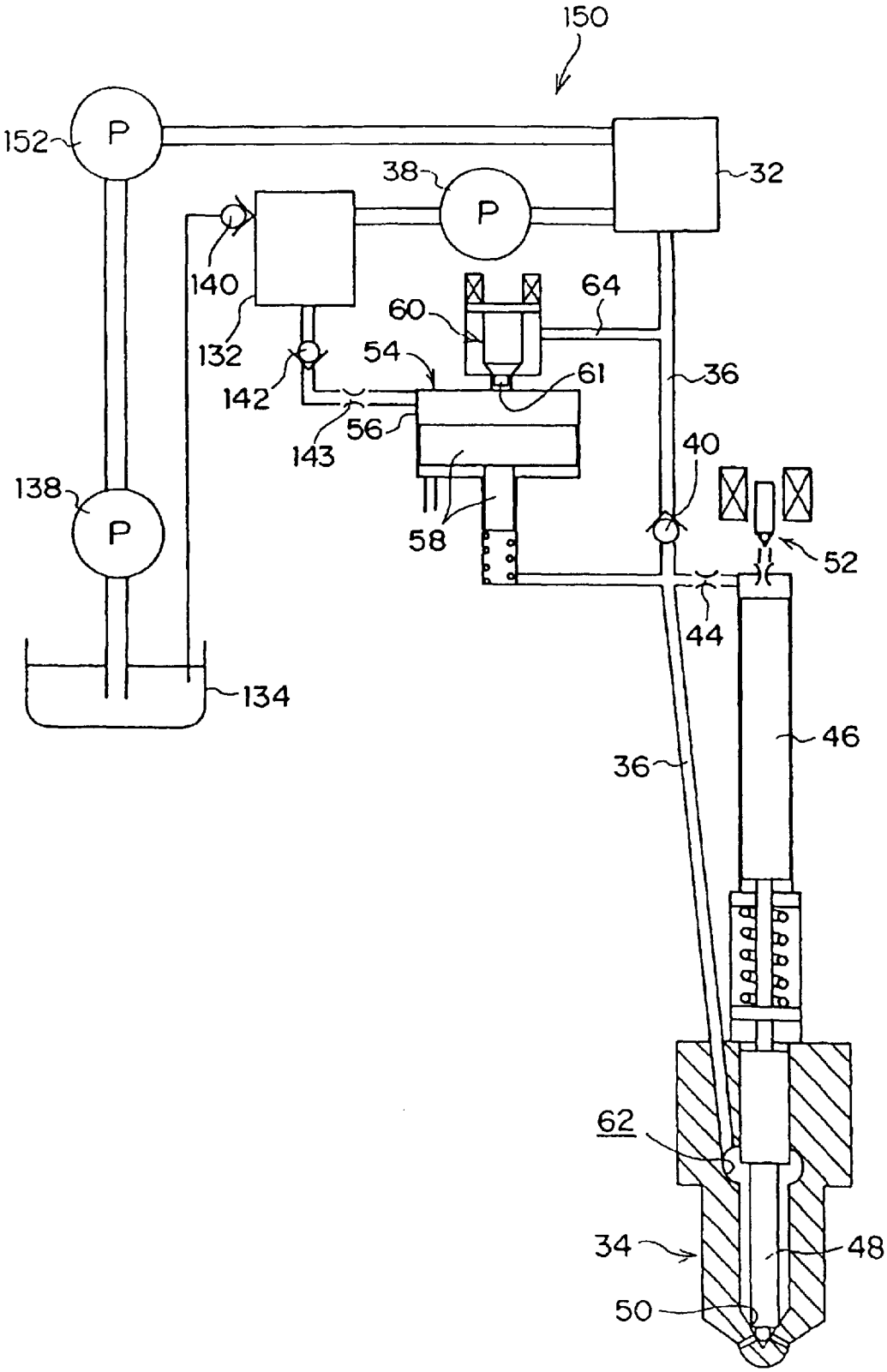
FIG. 23 is an overall structural view of a fuel injection device relating to a ninth embodiment of the present invention.
Figure 24A:
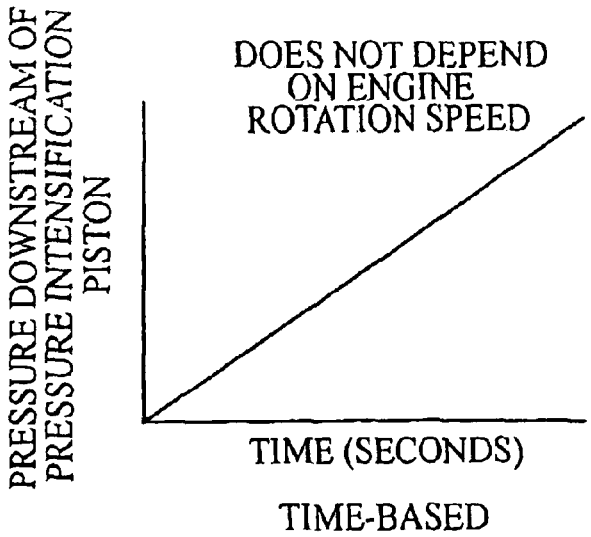
FIG. 24A is a graph showing a condition of variation of pressure at a downstream side of a pressure intensifier with respect to time in a case in which fuel injection is performed by a fuel injection method in a conventional fuel injection device.
Figure 24B:
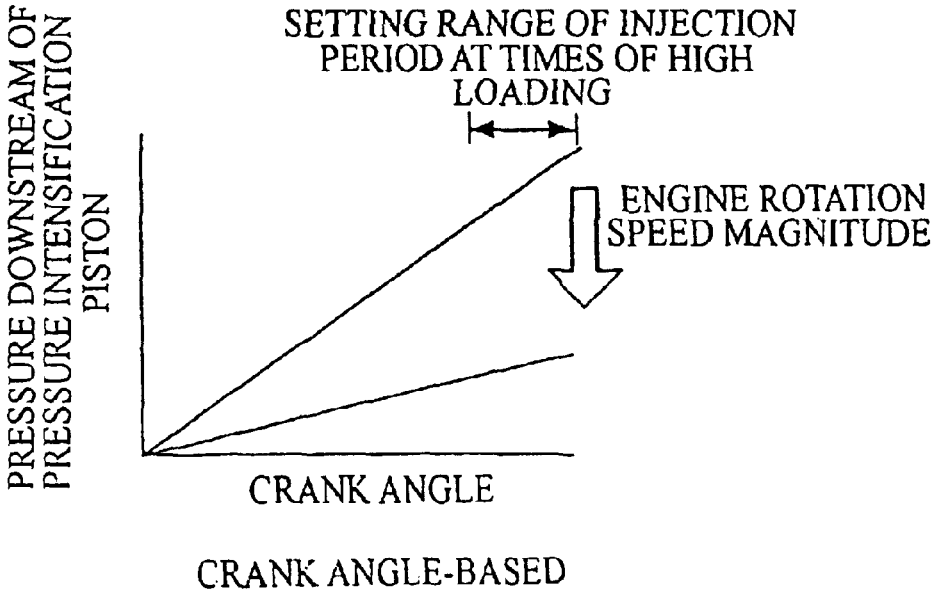
FIG. 24B is a graph showing a condition of variation of the pressure at the downstream side of the pressure intensifier with respect to crank angle in the case in which fuel injection is performed by the fuel injection method in the conventional fuel injection device.
Figure 25:
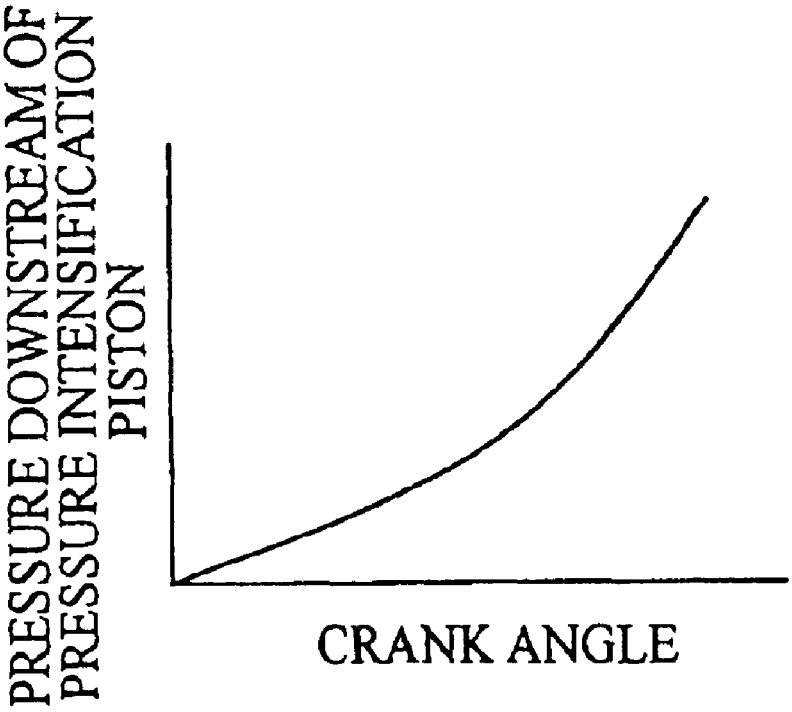
FIG. 25 is a graph relating to FIG. 24B, which shows a preferable condition of variation of pressure at a downstream side of a pressure intensifier in a case in which fuel injection is performed.

In FIG. 23, overall structure of a fuel injection device 150 relating to a ninth embodiment of the present invention is shown.

This fuel injection device 150 is a structure basically similar to the fuel injection device 130 relating to the eighth embodiment described above, but is a structure in which a supply pump 152, which is connected to the feed pump 138, is connected to the pressure accumulator (common rail) 32 just as it is.

That is, the supply pump 152 is a structure which pressurizes low-pressure fuel from the tank 134 (the feed pump 138) to high-pressure fuel, and supplies it to the pressure accumulator (common rail) 32 just as it is, without passing through the medium-pressure common rail 132.

In this fuel injection device 150 too, operations and effects similar to the fuel injection device 130 relating to the eighth embodiment described above are implemented.

By the way, in the first embodiment to the ninth embodiment described above, concerning the piston control valve 60, it has been described as a two-way valve-form structure, but is not limited to this, and this piston control valve 60 may be a three-way valve-form structure.

Potential for Exploitation in Industry

As above, a fuel injection device relating to the present invention can be utilized, for example, at an internal combustion engine such as a diesel engine or the like which is mounted at a vehicle and injects pumped fuel into a cylinder for driving.

What is claimed is:

1. A fuel injection device characterized by comprising:

a pressure accumulator communicated with a fuel pool in a fuel injection nozzle via a main fuel line, which accumulates pressure to set liquid fuel, which is pumped from a fuel pressurization pump, to a predetermined pressure;

a pressure-blocking valve provided partway along the main fuel line that communicates the fuel injection nozzle with the pressure accumulator, which blocks outflow of pressurized fuel from the fuel injection nozzle side toward the pressure accumulator side;

a fuel chamber for injection control which communicates at a downstream side, relative to the pressure-blocking valve, of the main fuel line that communicates the fuel injection nozzle with the pressure accumulator;

an injection control valve provided at the fuel chamber for injection control, which obtains closure of a needle valve in the fuel injection nozzle by effecting liquid fuel pressure at the fuel chamber for injection control, and opens the needle valve and obtains performance of fuel injection by removing liquid fuel of the fuel chamber for injection control;

a pressure intensifier having a cylinder and a piston, which communicates with the fuel chamber for injection control at the downstream side, relative to the pressure-blocking valve, of the main fuel line that communicates the fuel injection nozzle with the pressure accumulator; and a piston control valve which moves the piston of the pressure intensifier by flowing in fuel from the pressure accumulator to the cylinder or by flowing out fuel in the cylinder, and obtains an increase of fuel pressure of the downstream side relative to the pressure-blocking valve, wherein flow amount-changing means capable of changing flow amounts of the fuel that is flowed into the cylinder or flowed out by the piston control valve is provided.

2. The fuel injection device recited in claim 1, characterized by the flow amount-changing means being provided at the piston control valve and being a protrusion which changes an area of the fuel flow path of the cylinder in accordance with movement of the piston control valve.

3. The fuel injection device recited in claim 1, characterized by the flow amount-changing means having: a fixed orifice which communicates with a fuel chamber of the piston control valve; a movable orifice which overlaps and communicates with the fixed orifice, and changes a degree of overlap with the fixed orifice by moving; and moving means which moves the movable orifice.

4. The fuel injection device recited in claim 1, characterized by the flow amount-changing means being a pressure regulator which is provided at an inflow path of fuel into the cylinder or an outflow path of fuel from the cylinder.

5. The fuel injection device recited in claim 1, characterized by residual pressure-regulating means, which regulates pressure in the cylinder to a predetermined pressure at a time of non-operation of the piston control valve, being provided.

6. The fuel injection device recited in claim 1, characterized by resupplying means for again supplying fuel, which has been discharged from in the cylinder in accordance with movement of the piston at a time of operation of the piston control valve, to the fuel pressurization pump being provided.

7. A fuel injection device characterized by comprising:

a pressure accumulator communicated with a fuel pool in a fuel injection nozzle via a main fuel line, which accumulates pressure to set liquid fuel, which is pumped from a fuel pressurization pump, to a predetermined pressure;

a pressure-blocking valve provided partway along the main fuel line that communicates the fuel injection nozzle with the pressure accumulator, which blocks outflow of pressurized fuel from the fuel injection nozzle side toward the pressure accumulator side;

a fuel chamber for injection control which communicates at a downstream side, relative to the pressure-blocking valve, of the main fuel line that communicates the fuel injection nozzle with the pressure accumulator;

an injection control valve provided at the fuel chamber for injection control, which obtains closure of a needle valve in the fuel injection nozzle by effecting fuel pressure at the fuel chamber for injection control, and opens the needle valve and obtains performance of fuel injection by removing liquid fuel of the fuel chamber for injection control;

a pressure intensifier having a cylinder and a piston, which communicates with the fuel chamber for injection control at the downstream side, relative to the pressure-blocking valve, of the main fuel line that communicates the fuel injection nozzle with the pressure accumulator; and a piston control valve which moves the piston of the pressure intensifier by flowing in fuel from the pressure accumulator to the cylinder or by flowing out fuel in the cylinder, and obtains an increase of fuel pressure of the downstream side relative to the pressure-blocking valve, wherein residual pressure-regulating means which regulates pressure in the cylinder to a predetermined pressure at a time of non-operation of the piston control valve is provided.

8. The fuel injection device recited in claim 7, characterized by resupplying means for again supplying fuel, which has been discharged from in the cylinder in accordance with movement of the piston at a time of operation of the piston control valve, to the fuel pressurization pump being provided.

* * * * *